US010323428B2

(12) United States Patent
Collins et al.

(10) Patent No.: US 10,323,428 B2
(45) **Date of Patent: *Jun. 18, 2019**

(54) SEQUENCE FOR CONSTRUCTING A BUILDING FROM PREFABRICATED COMPONENTS

(71) Applicant: Innovative Building Technologies, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/974,877

(22) Filed: May 9, 2018

(65) Prior Publication Data

US 2018/0328056 A1 Nov. 15, 2018

Related U.S. Application Data

(60) Provisional application No. 62/505,666, filed on May 12, 2017.

(51) Int. Cl.
*E04B 1/04* (2006.01)
*E04B 1/24* (2006.01)
(Continued)

(52) U.S. Cl.
CPC ..... *E04H 1/005* (2013.01); *E04B 1/043* (2013.01); *E04B 1/24* (2013.01); *E04B 1/2403* (2013.01);
(Continued)

(58) Field of Classification Search
CPC ... E04H 1/005; E04B 1/2403; E04B 1/34315; E04B 1/348; E04B 1/043; E04B 1/2604
See application file for complete search history.

(56) References Cited

U.S. PATENT DOCUMENTS 1,168,556 A 1/1916 Robinson et al.
1,501,288 A * 7/1924 Morley ..... E04B 1/20 52/236.8
(Continued)

FOREIGN PATENT DOCUMENTS

AU 2005200682 5/2005
AU 2012211472 2/2014
(Continued)

OTHER PUBLICATIONS

"Beam to column connection", TATA Steel, http://www.tatasteelconstruction.com/en/reference/teaching_resources/architectural_studio_reference/elements/connections/beam to column connections, 2014, 4 pages.
(Continued)

*Primary Examiner* — Rodney Mintz

(57) ABSTRACT

A method of assembling a building from prefabricated components may include erecting a first plurality of columns spatially separated along a first line, erecting a second plurality of columns spatially separated along a second line, coupling a plurality of beams to and between the first and second pluralities of columns, coupling a prefabricated floor panel to and between adjacent beams of the plurality of beams, coupling a prefabricated demising wall above and along at least one of the plurality of beams positioned between the ends of adjacent prefabricated floor panels, and coupling a prefabricated end wall above and along at least one of the plurality of beams positioned at a terminal end of the building.

22 Claims, 14 Drawing Sheets

(51) Int. Cl.

| | |
|---|---|
| ***E04B 1/26*** | (2006.01) |
| ***E04H 1/00*** | (2006.01) |
| ***E04B 1/343*** | (2006.01) |
| ***E04B 1/348*** | (2006.01) |

(52) U.S. Cl.

CPC ..... *E04B 1/2604* (2013.01); *E04B 1/348* (2013.01); *E04B 1/34315* (2013.01); *E04B 2001/2481* (2013.01); *E04B 2001/2496* (2013.01)

(56) References Cited

U.S. PATENT DOCUMENTS 1,876,528 A 7/1931 Walters
1,883,376 A 10/1932 George et al.
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Walter
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,184,893 A 5/1965 Booth
3,221,454 A 12/1965 Togni
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,490,191 A 1/1970 Ekblom
3,579,935 A 5/1971 Regan et al.
3,590,393 A 7/1971 Hollander
3,594,965 A 7/1971 Saether
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A * 5/1975 Thunberg ..... E04B 1/24 52/127.11
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,038,796 A 8/1977 Eckel
4,050,215 A 9/1977 Fisher
4,059,936 A 11/1977 Lukens
4,078,345 A 3/1978 Piazzalunga
4,107,886 A 8/1978 Ray
4,112,173 A 9/1978 Roudebush
4,142,255 A 3/1979 Togni
4,161,087 A 7/1979 Levesque
4,171,545 A 10/1979 Kann
4,176,504 A 12/1979 Huggins
4,178,343 A 12/1979 Rojo, Jr.
4,206,162 A 6/1980 Vanderklaauw
4,214,413 A 7/1980 de Los Monteros
4,221,441 A 9/1980 Bain
4,226,061 A 10/1980 Day, Jr.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,592,175 A * 6/1986 Werner ..... E04H 1/04 52/79.9
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,856,244 A 8/1989 Clapp
4,862,663 A 9/1989 Krieger
4,893,435 A 1/1990 Shalit
4,910,932 A * 3/1990 Honigman ..... E04B 1/08 52/280
4,918,897 A 4/1990 Luedtke
4,919,164 A 4/1990 Barenburg
4,974,366 A 12/1990 Tizzoni
4,991,368 A 2/1991 Amstutz
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,154,029 A 10/1992 Sturgeon
5,185,971 A 2/1993 Johnson, Jr.
5,205,091 A 4/1993 Brown
5,212,921 A 5/1993 Unruh
5,233,810 A 8/1993 Jennings
5,307,600 A 5/1994 Simon, Jr.
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,459,966 A 10/1995 Suarez
5,471,804 A 12/1995 Winter, IV
5,493,838 A 2/1996 Ross
5,509,242 A 4/1996 Rechsteiner et al.
5,519,971 A 5/1996 Ramirez
5,528,877 A 6/1996 Franklin
5,584,142 A 12/1996 Spiess
5,592,796 A 1/1997 Landers
5,611,173 A 3/1997 Headrick et al.
5,628,158 A 5/1997 Porter
5,640,824 A 6/1997 Johnson
5,660,017 A 8/1997 Houghton
5,678,384 A 10/1997 Maze
5,697,189 A 12/1997 Miller

(56) References Cited

U.S. PATENT DOCUMENTS 5,699,643 A 12/1997 Kinard
5,706,607 A 1/1998 Frey
5,724,773 A 3/1998 Hall
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,154,774 A 11/2000 Furlong
6,170,214 B1 1/2001 Treister et al.
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,430,883 B1 8/2002 Paz et al.
6,446,396 B1 9/2002 Marangoni et al.
6,481,172 B1 11/2002 Porter
6,484,460 B2 11/2002 VanHaitsma
6,625,937 B1 9/2003 Parker
6,651,393 B2 11/2003 Don
6,729,094 B1 5/2004 Spencer et al.
6,748,709 B1 6/2004 Sherman et al.
6,837,013 B2 1/2005 Foderberg et al.
6,922,960 B2 8/2005 Sataka
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Levy
7,484,339 B2 2/2009 Fiehler
7,493,729 B1 2/2009 Semmes
7,574,837 B2 8/2009 Hagen, Jr. et al.
7,658,045 B2 2/2010 Elliott et al.
7,676,998 B2 3/2010 Lessard
7,694,462 B2 4/2010 O'Callaghan et al.
7,721,491 B2 5/2010 Appel
7,748,193 B2 7/2010 Knigge et al.
7,908,810 B2 3/2011 Payne, Jr. et al.
7,921,965 B1 4/2011 Surace
7,966,778 B2 6/2011 Klein
8,051,623 B2 11/2011 Loyd
8,096,084 B2 1/2012 Studebaker et al.
8,109,058 B2 2/2012 Miller
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,631,616 B2 * 1/2014 Carrion ..... E04B 1/04 52/235
8,733,046 B2 5/2014 Naidoo
8,769,891 B2 7/2014 Kelly
8,833,025 B2 9/2014 Krause
8,950,132 B2 2/2015 Collins et al.
8,966,845 B1 3/2015 Ciuperca
8,978,324 B2 3/2015 Collins et al.
8,997,424 B1 4/2015 Miller
9,027,307 B2 * 5/2015 Collins ..... E04B 1/24 52/745.16
9,382,709 B2 7/2016 Collins et al.
9,683,361 B2 * 6/2017 Timberlake ..... E04C 5/0604
10,041,289 B2 8/2018 Collins et al.
2002/0059763 A1 5/2002 Wong
2002/0170243 A1 11/2002 Don
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0200706 A1 10/2003 Kahan et al.
2003/0221381 A1 12/2003 Ting
2004/0065036 A1 4/2004 Capozzo
2004/0103596 A1 6/2004 Don
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.
2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2007/0000198 A1 1/2007 Payne
2007/0074464 A1 4/2007 Eldridge
2007/0107349 A1 5/2007 Erker
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0098676 A1 5/2008 Hutchens
2008/0104901 A1 5/2008 Olvera
2008/0168741 A1 7/2008 Gilgan
2008/0178542 A1 7/2008 Williams
2008/0202048 A1 8/2008 Miller et al.
2008/0222981 A1 9/2008 Gobbi
2008/0229669 A1 9/2008 Abdollahzadeh et al.
2008/0282626 A1 11/2008 Powers, Jr.
2008/0289265 A1 11/2008 Lessard
2008/0295450 A1 12/2008 Yogev
2009/0031652 A1 2/2009 Ortega Gatalan
2009/0038764 A1 2/2009 Pilz
2009/0077916 A1 3/2009 Scuderi et al.
2009/0090074 A1 4/2009 Klein

(56) References Cited

U.S. PATENT DOCUMENTS

2009/0100760 A1 4/2009 Ewing
2009/0100769 A1 4/2009 Barrett
2009/0107065 A1 4/2009 LeBlang
2009/0113820 A1 5/2009 Deans
2009/0134287 A1 5/2009 Klosowski
2009/0165399 A1 7/2009 Gines
2009/0188192 A1 7/2009 Studebaker et al.
2009/0188193 A1 7/2009 Studebaker et al.
2009/0205277 A1 8/2009 Gibson
2009/0293395 A1 12/2009 Porter
2009/0313931 A1 12/2009 Porter
2010/0064590 A1 3/2010 Jones et al.
2010/0064601 A1 3/2010 Napier
2010/0146874 A1 6/2010 Brown
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0325971 A1 12/2010 Leahy
2010/0325989 A1 12/2010 Leahy
2011/0023381 A1 2/2011 Weber
2011/0041411 A1 2/2011 Aragon
2011/0056147 A1* 3/2011 Beaudet ..... E04B 1/3483 52/79.9
2011/0113709 A1 5/2011 Pilz
2011/0126484 A1* 6/2011 Carrion ..... E04B 1/04 52/426
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1 12/2011 Collins et al.
2011/0296778 A1 12/2011 Collins et al.
2011/0296789 A1* 12/2011 Collins ..... E04B 1/24 52/741.4
2011/0300386 A1 12/2011 Pardue, Jr.
2012/0151869 A1 6/2012 Miller
2012/0167505 A1 7/2012 Krause
2012/0186174 A1 7/2012 LeBlang
2012/0210658 A1 8/2012 Logan
2012/0297712 A1 11/2012 Lutzner et al.
2012/0317923 A1 12/2012 Herdt et al.
2013/0025222 A1 1/2013 Mueller
2013/0036688 A1 2/2013 Gosain
2013/0067832 A1 3/2013 Collins et al.
2013/0111840 A1 5/2013 Bordener
2013/0133277 A1 5/2013 Lewis
2013/0232887 A1* 9/2013 Donnini ..... E04B 1/3442 52/79.5
2014/0013678 A1 1/2014 Deverini
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang
2014/0090323 A1 4/2014 Glancy
2014/0130441 A1 5/2014 Sugihara et al.
2015/0096251 A1 4/2015 McCandless et al.
2015/0211227 A1 7/2015 Collins et al.
2016/0122996 A1* 5/2016 Timberlake ..... E04C 5/0604 52/236.3
2016/0290030 A1 10/2016 Collins et al.
2016/0319534 A1* 11/2016 Bernardo ..... E04B 1/3483
2017/0284095 A1* 10/2017 Collins ..... E04C 2/284
2017/0299198 A1* 10/2017 Collins ..... E04C 2/50
2017/0306624 A1 10/2017 Graham et al.
2017/0306625 A1* 10/2017 Collins ..... E04C 2/288
2018/0038103 A1 2/2018 Neumayr
2018/0209136 A1* 7/2018 Aylward ..... E04B 1/3483

FOREIGN PATENT DOCUMENTS

CN 20137279 3/2008
CN 102587693 7/2012
CN 202299241 7/2012
CN 102733511 10/2012
DE 4205812 9/1993
DE 20315506 11/2004
EP 1045078 10/2000
EP 1375804 1/2004
EP 2128353 12/2009
EP 2213808 8/2010
EP 2238872 10/2010
EP 1739246 1/2011
EP 2281964 2/2011
FR 1317681 5/1963
FR 2988749 10/2013
GB 898905 6/1962
JP 52-015934 4/1977
JP 53-000014 1/1978
JP S54-084112 6/1979
JP 57-158451 9/1982
JP H0310985 1/1991
JP H049373 3/1992
JP H0752887 12/1995
JP 2576409 7/1998
JP 10234493 9/1998
JP H10245918 9/1998
JP 2000144997 5/2000
JP 3137760 2/2001
JP 2002536615 10/2002
JP 2002364104 12/2002
JP 2008073434 4/2008
JP 2008110104 5/2008
KR 1019990052255 7/1999
KR 1019990053902 7/1999
KR 100236196 12/1999
KR 102000200413000 10/2000
KR 20060066931 6/2006
WO 1991007557 5/1991
WO 1997022770 6/1997
WO 200046457 8/2000
WO 0058583 10/2000
WO 2002035029 5/2002
WO 2007059003 5/2007
WO 2010030060 3/2010
WO 2010037938 4/2010
WO 2016032537 3/2016
WO 2016032538 3/2016
WO 2016032539 3/2016
WO 2016032540 3/2016
WO 2016033429 3/2016
WO 2016033525 3/2016

OTHER PUBLICATIONS

"Emerging Trends 2012 Executive Summary", Urban Land Institute, Ch. 1, 2011, 1-11 pages.
"Emerging Trends in real estate", accessed on Sep. 15, 2016 at https://web.archive.orglweb120140813084823/http://pwc.corn.au/industry/real-estate/assets/Real-Estate-2012-Europe-Jan12.pdf, p. 60 (2012).
"How to Soundproof a Ceiling—Soundproofing Ceilings", http://www.soundproofingcompany.com/soundproofing-solutions/soundproof-a-ceiling/, Apr. 2, 2014, 1-7 pages.
"Insulspan Installation Guide", Obtained at: http://www.insulispan.com/downloads/InstallationGuide.pdf on Feb. 2, 2016, 58 pages.
"Structural Insulated Panel", Wikipedia, http://www.en.wikipedia.org//wiki/Structural_insulated_panel, May 30, 2014, 5 pages.
"Structural Insulated Panels", SIP Solutions, http://www.sipsolutions.com/content.structuralinsulated-panels, Aug. 15, 2014, 3 pages.
"US Apartment & Condominium Construction Forecast 2003-2017", Statista, Inc., 8 pages.

(56) References Cited

OTHER PUBLICATIONS

Azari, et al., "Modular Prefabricated Residential Construction—Constraints and Opportunities", PNCCRE Technical Report #TR002, Aug. 2013, 90 pages.
Borzouie, et al., "Seismic Assesment and Reahbilitation of Diaphragms", http://www.nosazimadares.ir/behsazi/15WCEE2012/URM/1/Roof.pdf, Dec. 31, 2011, 86 pages.
Framecad, "FC EW 1-12mm Fibre Cement Sheet +9mm MgO Board Wall Assembly", 2013, 2 pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 pages.
Gonchar, "Paradigm Shift—Multistory Modular", Architectural Record, Oct. 2012, pp. 144-148.
Kerin, et al., "National Apartment Market Report—2013", Marcus & Millichap, 2013, 1-9 pages.
M.A. Riusillo, "Lift Slab Construction: Its History, Methodology, Economics and Applications", ACI-Abstract, Jun. 1, 1988, 2 pages.
McIlwain, "Housing in America—The Next Decade", Urban Land Institute, 2010, 1-28 pages.
McIlwain, "The Rental Boost From Green Design", Urban Land, http://urbanland.uli.org/sustainability/the-rental-boost-from-green-design/, Jan. 4, 2012, 1-6 pages.
Shashaty, "Housing Demand", Sustainable Communities, Apr. 2011, 14-18 pages.
Sichelman, "Severe Apartment Shortage Looms", Urban Land, http://urbanland.uli.org/capital-markets/nahb-orlando-severe-apartmentshortage-looms/, Jan. 13, 2011, 1-2 pages.
USPTO, International Search Report and Written Opinion for International Patent Application No. PCT/US2011/001039, dated Oct. 5, 2011, 9 pages.
USPTO, International Search Report and Written Opinion for International Patent Application No. PCT/US/2014/053613, dated Dec. 18, 2014, 13 pages.
USPTO, International Search Report and Written Opinion for International Patent Application No. PCT/US/2014/053614, dated Dec. 18, 2014, 11 pages.
USPTO, International Search Report and Written Opinion for International Patent Application No. PCT/US/2014/053616, dated Dec. 17, 2014, 9 pages.
USPTO, International Search Report and Written Opinion for International Patent Application No. PCT/US/2014/053615, dated Dec. 17, 2014, 11 pages.
USPTO, International Search Report and Written Opinion for International Patent Application No. PCT/US15/47536, dated Dec. 4, 2015, 17 pages.
USPTO, International Search Report and Written Opinion for International Patent Application No. PCT/US2015/047383, dated Jan. 12, 2016, 14 pages.
USPTO, International Search Report and Written Opinion for International Patent Application No. PCT/US2011/001039, dated Oct. 5, 2011, 14 pages.
EPO, European Search Report for European Patent Application No. 15836516.3, dated Jun. 22, 2018, 10 pages.
EPO, European Search Report for European Patent Application No. 14891125.8, dated Jul. 8, 2016, 4 pages.
EPO, Extended European Search Report for European Patent Application No. 14900469.9, dated Mar. 20, 2018, 8 pages.
Stiemer, S F, "Bolted Beam-column Connections", http://faculty.philau.edu/pastorec/Tensile/bolted_beam_column_connections.pdf, Nov. 11, 2007, 1-16 pages.

* cited by examiner

SEQUENCE FOR CONSTRUCTING A BUILDING FROM PREFABRICATED COMPONENTS

CROSS-REFERENCE TO RELATED APPLICATION

The present application is a non-provisional application that claims priority under 35 U.S.C. § 119(e) to U.S. Provisional Application No. 62/505,666, filed on May 12, 2017, the entirety of which is incorporated herein by reference.

BACKGROUND

Conventional construction is conducted in the field at the building job site. People in various trades (e.g., carpenters, electricians, and plumbers) measure, cut, and install material as though each unit were one-of-a-kind. Furthermore, activities performed by the trades are arranged in a linear sequence. The result is a time-consuming process that increases the risk of waste, installation imperfections, and cost overruns. One approach to improving efficiency in building construction may be modular construction. In the case of buildings with multiple dwelling units (e.g., apartments, hotels, student dorms, etc.), entire dwelling units (referred to as modules) may be built off-site in a factory and then trucked to the job site. The modules are then stacked and connected together, generally resulting in a low-rise construction (e.g., between one and six stories). Other modular construction techniques may involve the building of large components of the individual units off-site (e.g., in a factory) and assembling the large components in the field to reduce the overall construction effort at the job site and thereby reducing the overall time of erecting the building. However, shortcomings may exist with known modular building technologies and improvements thereof may be desirable.

SUMMARY

Techniques are generally described that include methods and systems relating to building construction and more specifically relating to constructing a building from prefabricated components. An example method may include assembling a building from prefabricated components. The method may include erecting a first plurality of columns spatially separated along a first line, erecting a second plurality of columns spatially separated along a second line, coupling a plurality of beams to and between the first and second pluralities of columns, coupling a prefabricated floor panel to and between adjacent beams of the plurality of beams, coupling a prefabricated demising wall above and along at least one of the plurality of beams positioned between the ends of adjacent prefabricated floor panels, and coupling a prefabricated end wall above and along at least one of the plurality of beams positioned at a terminal end of the building. Each beam of the plurality of beams may extend between one column of the first plurality of columns and an opposing column of the second plurality of columns such that the plurality of beams extend substantially parallel to one another. The prefabricated floor panel may include opposite ends and opposite sides extending between the opposite ends, wherein the opposite ends of each prefabricated floor panel are coupled to adjacent beams, and wherein the prefabricated floor panel includes a plurality of joists in a spaced arrangement and extending between the opposite ends.

In some examples, the method may include coupling a second plurality of beams to and between the first and second pluralities of columns, each beam of the second plurality of beams extending above and along at least one prefabricated demising wall or at least one prefabricated end wall. The method may include coupling a prefabricated second floor panel to and between adjacent beams of the second plurality of beams. The method may include coupling a prefabricated second demising wall above and along at least one of the second plurality of beams positioned between the ends of adjacent prefabricated second floor panels. The method may include coupling a prefabricated second end wall above and along at least one of the second plurality of beams positioned at a terminal end of the building. The method may include coupling a prefabricated utility wall along a terminal side of the building, each prefabricated utility wall coupled to at least one of the prefabricated floor panels and at least one of the prefabricated second floor panels positioned adjacent the terminal side of the building.

In some examples, one of the opposite sides of each prefabricated floor panel positioned adjacent a terminal side of the building may define an outer side arranged to sealingly receive a window along its length.

In some examples, coupling the prefabricated floor panel to and between adjacent beams of the plurality of beams may include coupling a plurality of prefabricated floor panels to and between each pair of adjacent beams of the plurality of beams, the plurality of prefabricated floor panels abutting one another along the sides of the plurality of prefabricated floor panels. Coupling the plurality of prefabricated floor panels to and between adjacent beams of the plurality of beams may include coupling three prefabricated floor panels to and between each pair of adjacent beams.

In some examples, the second line may extend substantially parallel to the first line.

Another example method includes assembling a building from prefabricated components, the building including a length and a width defining terminal ends and terminal sides of the building, respectively. The method may include erecting first and second rows of columns along the length of the building, attaching a plurality of floor beams to and between the first and second rows of columns such that the plurality of floor beams extend substantially parallel to one another along the width of the building, attaching a prefabricated floor panel to and between adjacent floor beams of the plurality of floor beams, attaching a prefabricated demising wall to and along at least one of the plurality of floor beams positioned between adjacent prefabricated floor panels, attaching a prefabricated end wall to and along at least one of the plurality of floor beams positioned at a terminal end of the building, attaching a plurality of vertically adjacent floor beams to and between the first and second rows of columns, and repeating steps 3-6 above in sequence until the building includes a desired number of stories. The plurality of vertically adjacent floor beams may be attached to and along the tops of the prefabricated demising and end walls of the vertically subjacent story.

In some examples, the method may include attaching at least one prefabricated utility wall along one of the terminal sides of the building, each prefabricated utility wall serving at least two stories of the building. The method may include attaching a window wall along the terminal side of the building opposing the at least one prefabricated utility wall.

In some examples, the first and second rows of columns may be erected substantially parallel to each other.

In some examples, the repeating step may include extending the lengths of the columns to achieve the desired number of stories.

Another example method includes assembling a building of n stories from prefabricated components, the building including a length and a width. The method may include erecting first and second rows of columns along the length of the building, installing a plurality of first floor beams to and between the first and second rows of columns such that the plurality of first floor beams extend along the width of the building, installing a prefabricated first floor panel to and between adjacent beams of the plurality of first floor beams, installing a prefabricated first floor demising wall above and along at least one of the plurality of first floor beams positioned between adjacent prefabricated first floor panels, installing a prefabricated first floor end wall above and along at least one of the plurality of first floor beams positioned at terminal ends of the building, installing a plurality of second floor beams to and between the first and second rows of columns such that the plurality of second floor beams extend along the width of the building, installing a prefabricated second floor panel to and between adjacent beams of the plurality of second floor beams, installing a prefabricated second floor demising wall above and along at least one of the plurality of second floor beams positioned between adjacent prefabricated second floor panels, installing a prefabricated second floor end wall above and along at least one of the plurality of second floor beams positioned at terminal ends of the building, installing a plurality of third floor beams to and between the first and second rows of columns such that the plurality of third floor beams extend along the width of the building, installing a prefabricated utility wall along a terminal side of the building, each prefabricated utility wall serving two stories of the building, and repeating the above steps until the building includes n stories. The second floor beams may extend above and along the prefabricated first floor demising walls and the prefabricated first floor end walls. The third floor beams may extend above and along the prefabricated second floor demising walls and the prefabricated second floor end walls.

In some examples, the repeating step may include extending the lengths of the columns to accommodate n stories.

In some examples, the method may include installing a window wall along a terminal side of the building opposite the prefabricated utility wall. Installing the window wall may include attaching a window along corresponding tracks pre-installed on the prefabricated floor panels.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

Figure 1:
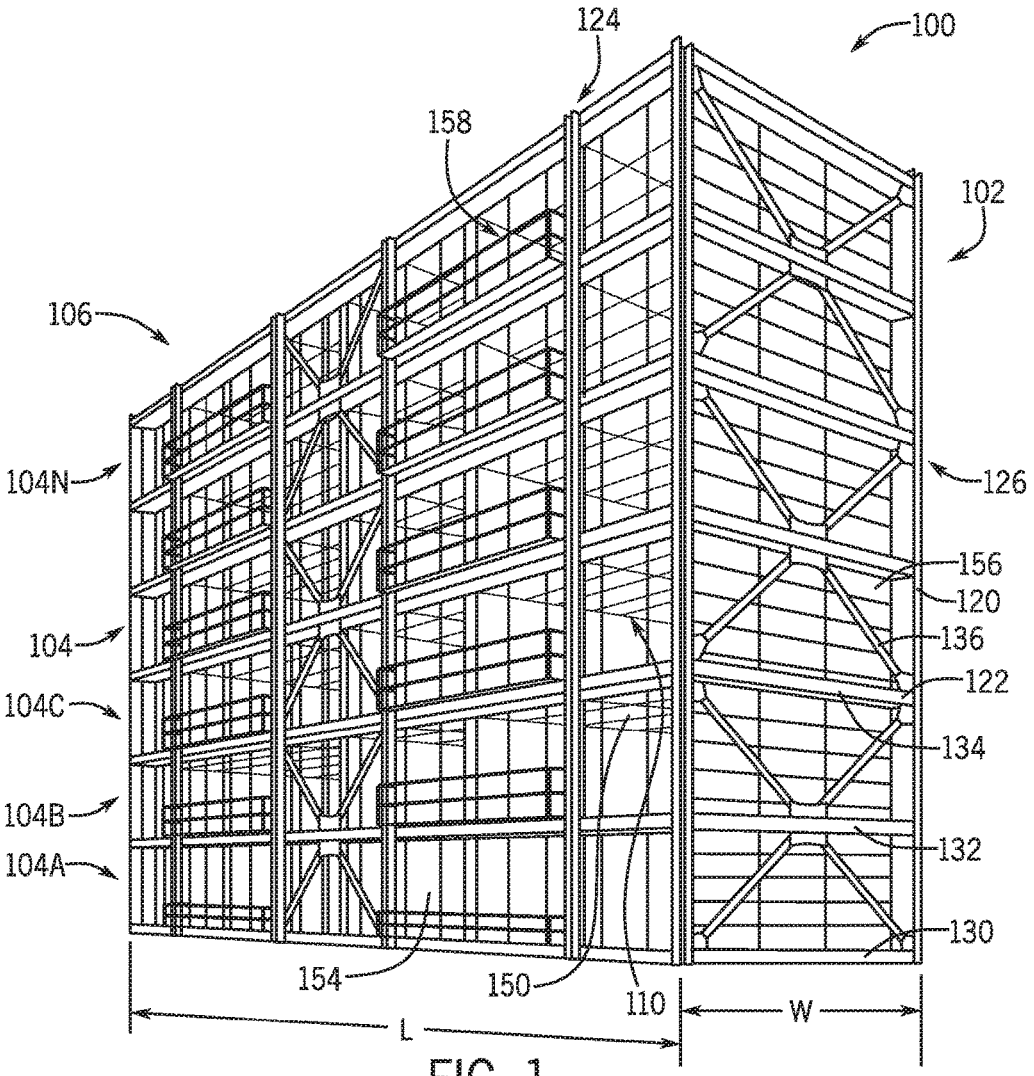
FIG. 1 is a schematic illustration of an example multistory building assembled from prefabricated components.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatus generally related to constructing a building from prefabricated components. In some examples, the prefabricated components may be assembled off-site (such as in a shop) and then transported to the building site for constructing a building. At the building site, the prefabricated components may be attached together and/or to a building frame, either directly or indirectly. The building frame may be an external frame. The term external frame, also referred to as external structural frame, will be understood to refer to a structural frame of a building which is arranged generally externally to the envelope of the building. This is, in contrast to other types of structural frames that include vertical and horizontal load bearing members located within the perimeter defined by the building envelope, as is typical in timber construction for example, the external frame is arranged outside the perimeter of the building envelope. As is generally known in the field of structural engineering, the structural frame is the load-resisting or load-beating system of a building which transfers loads (e.g., vertical and lateral loads) into the foundation of the building trough interconnected structural components (e.g., load bearing members, such as beams, columns, load-bearing walls, etc.).

In some examples of the present disclosure, a sequence for constructing a building from prefabricated components is provided. For example, according to various examples described herein, a method of assembling a building from prefabricated components is provided. As described herein, the method includes erecting a structural frame and coupling a plurality of prefabricated components to the frame. In this manner, the building may be constructed with improved efficiency and/or reduced cost compared to typical multi-story building construction. For example, the building sequence disclosed herein may remove one or more steps from a conventional building construction process, such as removing the step of pouring/curing concrete walls and floors as is typical in some multi-story building construction.

As one example, the method may include erecting a first plurality of columns spatially separated along a first line, erecting a second plurality of columns spatially separated along a second line, coupling a plurality of beams to and between the first and second pluralities of columns, coupling a prefabricated floor panel to and between adjacent beams of the plurality of beams, coupling a prefabricated demising wall above and along at least one of the plurality of beams positioned between the ends of adjacent prefabricated floor panels, and coupling a prefabricated end wall above and along at least one of the plurality of beams positioned at a terminal end of the building. Each beam of the plurality of beams may extend between one column of the first plurality of columns and an opposing column of the second plurality of columns such that the plurality of beams extend substantially parallel to one another. The prefabricated floor panel may include opposite ends and opposite sides extending between the opposite ends, wherein the opposite ends of each prefabricated floor panel are coupled to adjacent beams, and wherein the prefabricated floor panel includes a plurality of joists in a spaced arrangement and extending between the opposite ends As another example, the method may include erecting first and second rows of columns along the length of the building, attaching a plurality of floor beams to and between the first and second rows of columns such that the plurality of floor beams extend substantially parallel to one another along the width of the building, attaching a prefabricated floor panel to and between adjacent floor beams of the plurality of floor beams, attaching a prefabricated demising wall to and along at least one of the plurality of floor beams positioned between adjacent prefabricated floor panels, attaching a prefabricated end wall to and along at least one of the plurality of floor beams positioned at a terminal end of the building, attaching a plurality of vertically adjacent floor beams to and between the first and second rows of columns, and repeating steps 3-6 above in sequence until the building includes a desired number of stories. In some examples, the vertically adjacent floor beams may be attached to and along the tops of the prefabricated demising and end walls of the vertically subjacent story.

As another example, the method may include erecting first and second rows of columns along the length of the building, installing a plurality of first floor beams to and between the first and second rows of columns such that the plurality of first floor beams extend along the width of the building, installing a prefabricated first floor panel to and between adjacent beams of the plurality of first floor beams, installing a prefabricated first floor demising wall above and along at least one of the plurality of first floor beams positioned between adjacent prefabricated first floor panels, installing a prefabricated first floor end wall above and along at least one of the plurality of first floor beams positioned at terminal ends of the building, installing a plurality of second floor beams to and between the first and second rows of columns such that the plurality of second floor beams extend along the width of the building, installing a prefabricated second floor panel to and between adjacent beams of the plurality of second floor beams, installing a prefabricated second floor demising wall above and along at least one of the plurality of second floor beams positioned between adjacent prefabricated second floor panels, installing a prefabricated second floor end wall above and along at least one of the plurality of second floor beams positioned at terminal ends of the building, installing a plurality of third floor beams to and between the first and second rows of columns such that the plurality of third floor beams extend along the width of the building, installing a prefabricated utility wall along a terminal side of the building, each prefabricated utility wall serving two stories of the building, and repeating the above steps until the building includes n stories. The second floor beams may extend above and along the prefabricated first floor demising walls and the prefabricated first floor end walls. The third floor beams may extend above and along the prefabricated second floor demising walls and the prefabricated second floor end walls.

In referring now to the drawings, repeating units of the same kind or generally fungible kind are designated by the part number and a letter (e.g., **214*n***), where the letters "a", "b", "c" and so on refer to a discrete number of the repeating items. General reference to the part number followed by the letter "n" indicates there is no predetermined or established limit to the number of items intended. The parts are listed as "a-n" referring to starting at "a" and ending at any desired number "n".

FIG. 1 illustrates an example building 100 arranged in accordance with at least some embodiments described herein. FIG. 1 shows the building 100 including a structural frame 102 and one or more floors, levels, or stories 104. When assembled or constructed, the building 100 includes a width W and a length L, which in some examples is greater than the building's width W. In such embodiments, the sides of the building 100 defining the length L of the building 100 may be referred to as terminal sides of the building 100. In like manner, the sides of the building 100 defining the width W of the building 100 may be referred to as terminal ends of the building 100. As described more fully below, the building 100 may be constructed by assembling various prefabricated components 106 (such as prefabricated columns, beams, floor panels, and walls) together. As described herein, the prefabricated components 106 may be assembled independent of one another remotely from the building site and transported to the building site for installation. As described herein, the prefabricated components 106 may include all components or substantially all of the components for a particular system of the building 100, such as a floor system or a wall system of the building 100. As explained below, the prefabricated components 106 may fit, or otherwise be coupled, together to complete the various systems of the building 100. For example, the prefabricated components 106 may be coupled or otherwise attached to the structural frame 102, to adjacent prefabricated components 106, or to both the structural frame 102 and one or more adjacent prefabricated components 106 at the building site to define the building 100, as more fully explained below.

Using prefabricated components 106, the building 100 may be constructed or assembled in reduced time and with a reduced amount of waste when compared to traditional construction methods. For example, in typical multi-story building construction, the various systems of a building may be constructed or assembled in situ, sometimes requiring large or vast storage and staging areas, numerous tools and construction equipment, as well as complicated (and inefficient) inventory and scheduling management. Large amounts of waste are also produced in typical multi-story building construction as each system is assembled or constructed on site. This waste may be detrimental to the construction process, such as increasing building costs and/or cluttering the construction area, which may cause otherwise preventable injuries from trips and falls.

On the other hand, implementing the various examples herein may reduce waste and reduce the time necessary to construct building 100. For example, and without limitation, because the various prefabricated components 106 fit, or are otherwise coupled, together, there is little to no construction waste produced at the jobsite, thereby creating a cleaner (and more efficient) jobsite. The examples of the present disclosure may also require storage and staging areas that are substantially smaller than those of typical multi-story building construction. For example, the prefabricated components 106 may be lifted off of a delivery truck and immediately placed in position without requiring preparation of the components in a staging area. Thus, the examples of the present disclosure may be beneficial for building sites where there is little to no room for storage or staging areas, such as in crowded metropolitan areas.

As shown in FIG. 1, the building 100 may include multiple building modules or units 110. The building units 110 may be commercial, residential (e.g., dwelling units, residences, etc.), or both. The building units 110 may be assembled at the building site using multiple pre-assembled or prefabricated components 106. Each building unit 110 may be assembled in accordance with a floor plan of the building 100. For example, in accordance with a floor plan, each story 104 of the building 100 may include one or multiple building units 110 defined by the prefabricated components 106. For example, depending on the size of the building 100, the desired number of building units 110, and/or local zoning and building requirements, each story 104 of the building 100 may include one, two, three, four, or more building units 110. In some embodiments, a building unit 110 may span more than one floor of the building 100 to define a multi-story building unit (e.g., a two-story building unit).

The building units 110 may be standardized and repetitive, or unique and individualized. Mixed units of standard size and shape may be combined with unique units in the same story 104, or in independent arrangement on separate stories 104. Additionally or alternatively, the building units 110 of each story 104 may be repetitive or mixed. For example, each building unit 110 on one story 104 may be identical to one another. In such examples, each building unit 110 on another story 104 may be identical to one another but different from other stories 104. Additionally or alternatively, a story 104 of the building 100 may include multiple building units 110 with a building unit 110 of the story 104 assembled differently than at least another building unit 110 of the same story 104. In one example, the building units 110 on the same end of the building 100 may be assembled identically. In other examples, the building units 110 within the interior of each story 104 may be assembled identically. In some examples, each vertically adjacent building unit 110 may be assembled identically. The foregoing examples are meant to be illustrative only, and the building units 110 of the building 100 may be assembled in accordance with any permutation or combination of configurations.

With continued reference to FIG. 1, the building 100 may include a structural frame 102 providing structural support for the building 100. The structural frame 102, which may be at least partially external to the building 100 in some examples, may serve at least partially as a structural skeleton (such as an exoskeleton) of the building 100. The structural frame 102 may include multiple support members, such as a plurality of columns 120 and a plurality of beams 122. The columns 120, which may be referred to as load bearing members, may be oriented vertically. The beams 122, which may be referred to as floor beams, may be oriented horizontally.

The beams 122 may extend between and be attached to adjacent columns 120 to at least partially define a structural framework of the building 100. For example, the structural frame 102 may include first and second rows of columns 124, 126 extending along the length L of the building 100, and a plurality of beams 122 coupled to and between the first and second rows of columns 124, 126 such that the beams 122 extend substantially parallel to one another along the width W of the building 100. The first row of columns 124, which may be referred to as a first plurality of columns, may be spatially separated along a first line. Similarly, and the second row of columns 126, which may be referred to as a second plurality of columns, may be spatially separated along a second line.

In some embodiments, a plurality of beams 122 may be attached or otherwise coupled to the columns 122 (e.g., to the first and second rows of columns 124, 126) to define a structural framework for each story 104 of the building 100. For example, a plurality of first floor beams 130 may be installed to and between the columns 120 (e.g., to and between the first and second rows of columns 124, 126) to at least partially define a structural framework for a first story 104A of the building 100. Similarly, a plurality of vertically adjacent beams 122, such as a plurality of second floor beams 132, may be installed to and between the columns 120 (e.g., to and between the first and second rows of columns 124, 126) to at least partially define a structural framework for a vertically adjacent story 104 (e.g., a second story 104B) of the building 100. In like manner, a plurality of third floor beams 134 may be installed to and between the columns 120 (e.g., to and between the first and second rows of columns 124, 126) to at least partially define a structure framework for a third story 104C of the building 100. This framework may be repeated to define a desired number of stories 104 of the building 100, such as up to an $n^{th}$ story 104N of the building 100, as explained below. Depending on the particular application, the beams 122 of a vertically adjacent story 104 may extend above and along the walls of the vertically subjacent story 104, as explained more fully below.

The beams 122 may be attached or otherwise coupled to the columns 120 in substantially any suitable manner, such as by welding and/or by bolting the components together. In such examples, various prefabricated components 106 (e.g., prefabricated floors and walls) may be attached or otherwise coupled to the beams 122 and/or to the columns 120. For example, as detailed below, prefabricated floors and walls may be attached or otherwise coupled to the beams 122 and/or to the columns 120 to define the various building units 110 of each story 104 of the building 100.

In some embodiments, the structural frame 102 may include additional structural elements, such as one or more cross braces 136 extending between, such as obliquely to, the columns 120 and the beams 122, to provide additional stiffness to the structural frame 102, such as increasing the lateral stability of the building 100. The structural frame 102 may be configured to provide most, or substantially all, the structural support for the building 100. In some embodiments, the structural frame 102 may provide a desired aesthetic appeal (e.g., architectural design, decoration, etc.) or added support to the building 100.

The various components shown in FIG. 1 are merely illustrative, and other variations, including eliminating components, combining components, and substituting components are all contemplated. Though FIG. 1 shows the building 100 as a six-story building, the building 100 may include any number of suitable stories 104 depending on the particular application, as explained below. For example, the building 100 may include any number of stories 104 (e.g., n stories 104) limited only by local zoning and building codes, among others. In embodiments where the building 100 includes two or more stories 104, the building 100 may be considered a multi-story building. In such examples, the building 100 may be classified as a low-rise, a mid-rise, or a high-rise construction depending on the number of stories 104. In some embodiments, the building 100 may be a residential multi-dwelling building having one or more stories 104, such as one story 104, two stories 104, six stories 104, ten stories 104, thirty stories 104, more than thirty stories 104, or the like.

Figure 2:
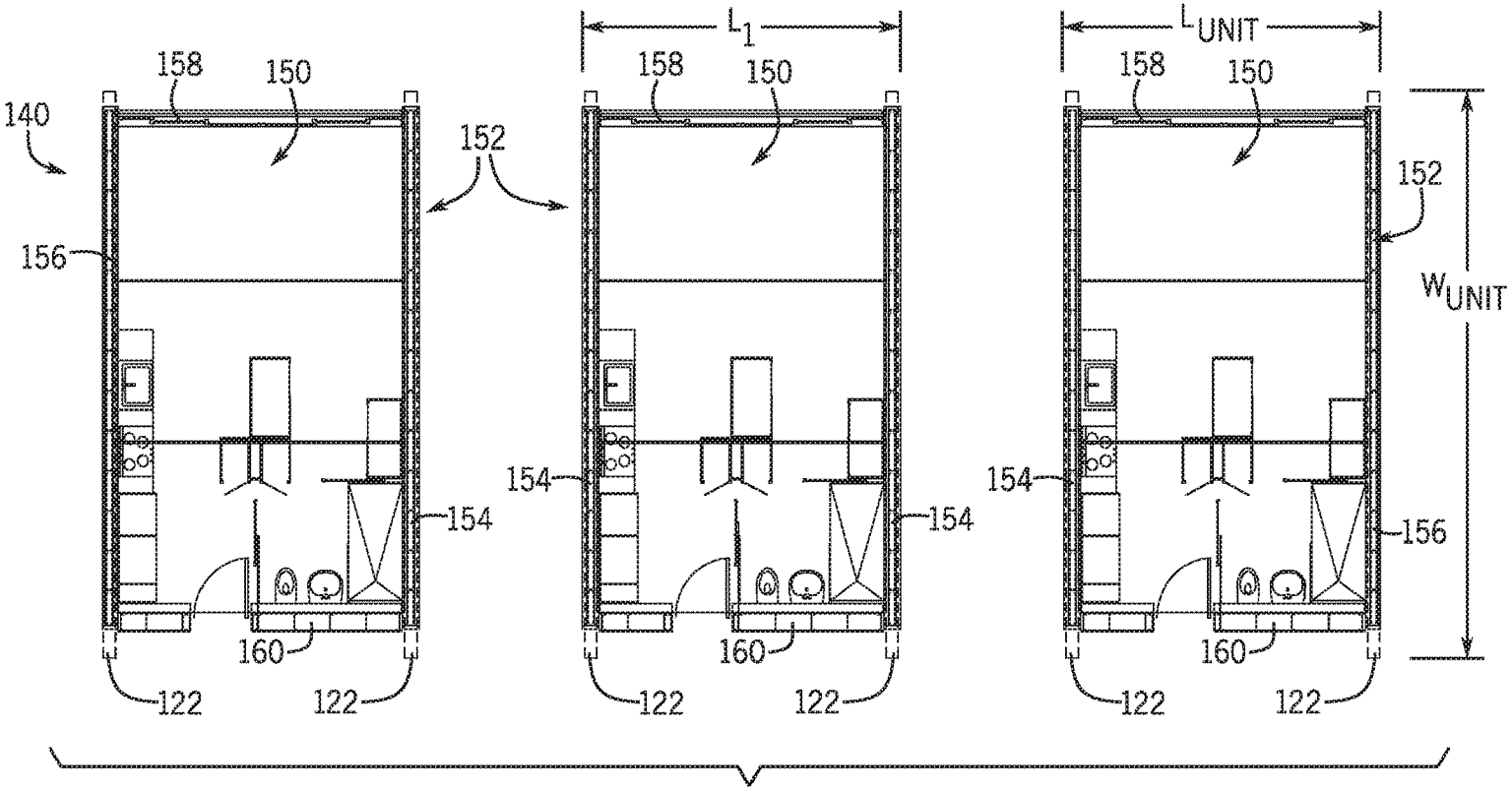
FIG. 2 is a schematic illustration of example floor plans of a plurality of building units assembled from prefabricated components.
Figure 3:
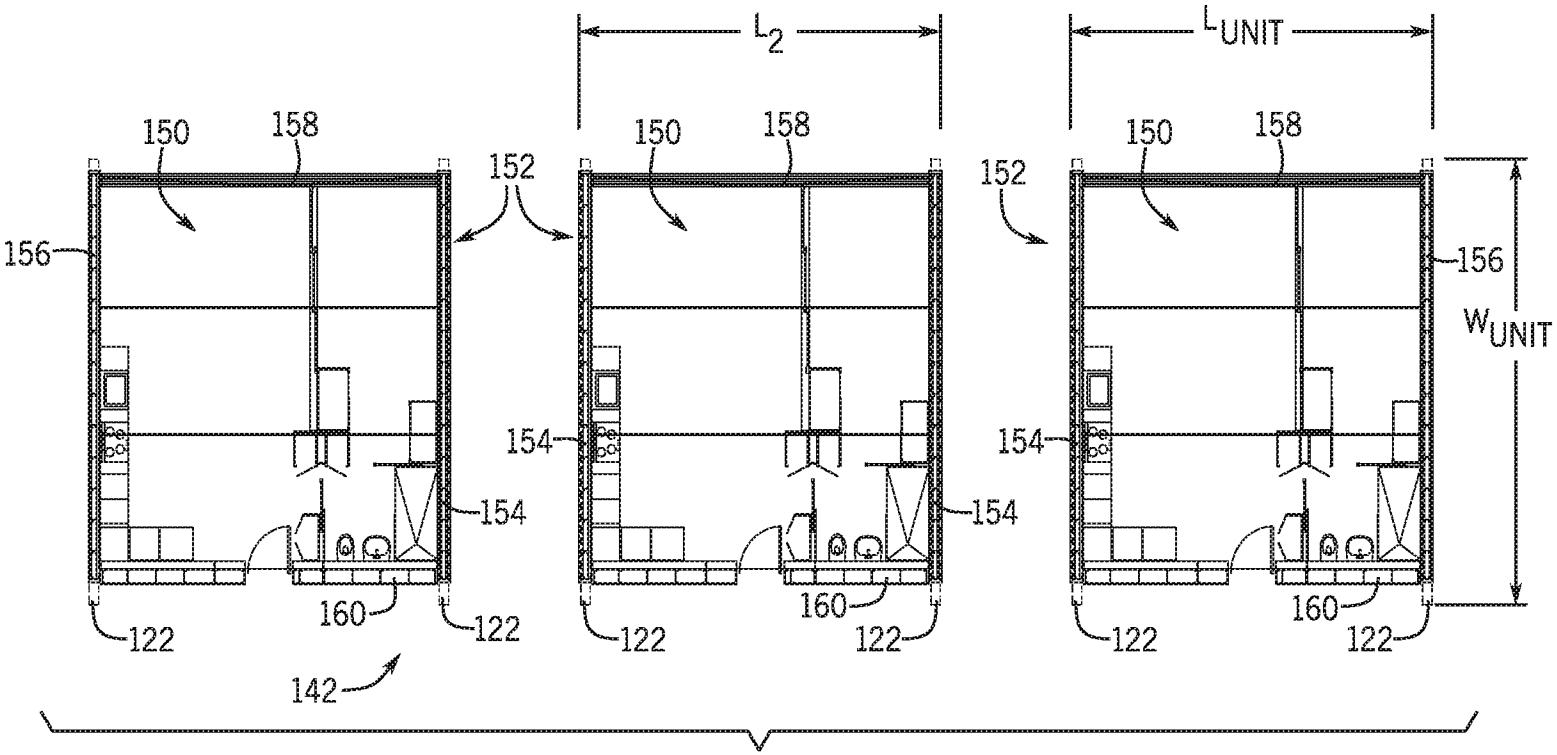
FIG. 3 is a another schematic illustration of example floor plans of a plurality of building units assembled from prefabricated components.
Figure 4:
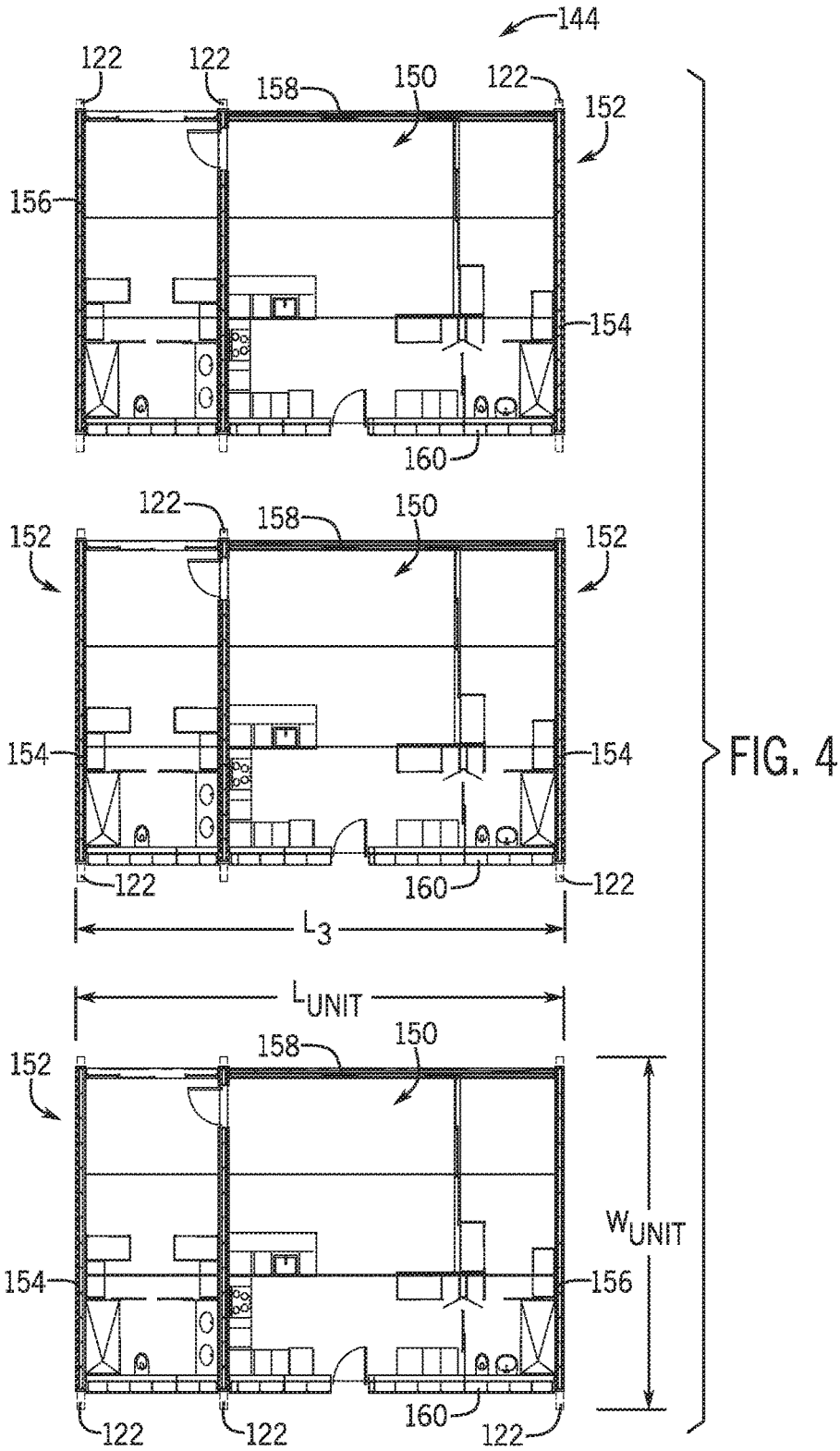
FIG. 4 is a another schematic illustration of example floor plans of a plurality of building units assembled from prefabricated components.
Figure 5:
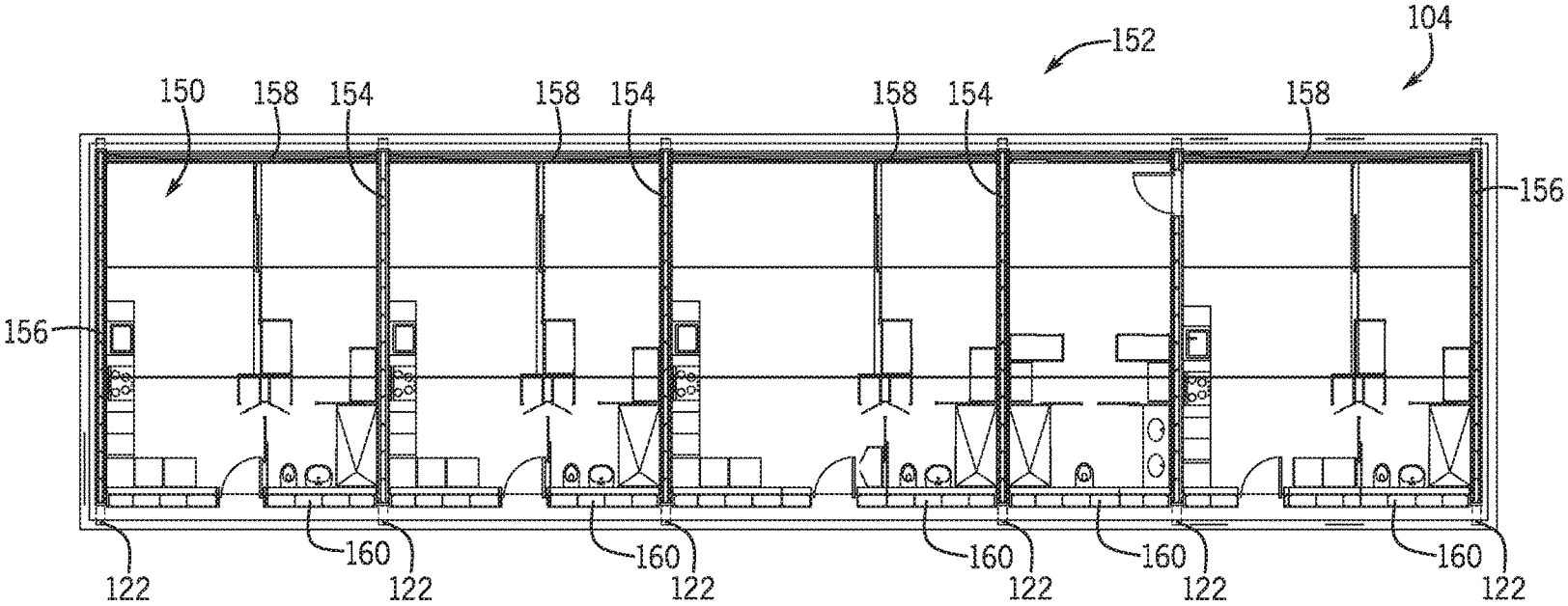
FIG. 5 is a schematic illustration of an example building story floor plan.

FIGS. 2-5 illustrate example floor plans of the building 100 assembled from prefabricated components 106. FIG. 2 shows floor plans of a first plurality of building units 140 according to some examples herein. FIG. 3 shows floor plans of a second plurality of building units 142 according to some examples herein. FIG. 4 shows floor plans of a third plurality of building units 144 according to some examples herein. FIG. 5 shows a floor plan of a story 104 of the building 100 according to some examples herein. In the examples of FIGS. 2-4, the first plurality of building units 140 may each be a studio residence, the second plurality of building units 142 may each be a one-bedroom residence, and the third plurality of building units 144 may each be a two-bedroom residence.

Each building unit 110 includes a unit width $W_{Unit}$ and a unit length $L_{Unit}$ extending along the building's width W and length L, respectively. In at least one example, a studio residence may include a first length $L_1$, a one-bedroom residence may include a second length $L_2$, and a 2-bedroom residence may include a third length $L_3$. The third length $L_3$ may be greater than the second length $L_2$. The second length $L_2$ may be greater than the first length $L_1$. The unit width $W_{Unit}$ of each building unit 110 may be arranged depending on the particular building arrangement. For example, each building unit 110 on the same story 104 may include the same unit width $W_{Unit}$. In some examples, each building unit 110 in the building 100 may include the same unit width $W_{Unit}$.

Depending on the particular application, each story 104 of the building 100 may include building units 110 assembled in accordance with the various floor plans of one or more of the first, second, and third pluralities of building units 140, 142, 144. For example, each story 104 of the building 100 may be assembled to include any combination of studio, one-bedroom, and two-bedroom residences. For example, as shown in FIG. 5, at least one story 104 of the building 100 may include a one-bedroom residence (e.g., three one-bedroom residences) and a two-bedroom residence (e.g., one two-bedroom residence). FIG. 5 is illustrative only and other combinations are contemplated.

Each floor plan includes a plurality of prefabricated floor panels 150 and a plurality of prefabricated walls 152 (such as any suitable combination of prefabricated demising walls 154, end walls 156, window walls 158, utility walls 160, as explained below). Each floor plan is designed to provide a desired characteristic of the respective building unit 110. For example, each floor plan may be designed to provide the unit width $W_{Unit}$, the unit length $L_{Unit}$, and/or a desired look and feel (e.g., flow) of the building unit 110, among others. The various components and floor plans shown in FIGS. 2-5 are merely illustrative, and other variations, such as eliminating components, combining components, and substituting components, are contemplated. To that end, one of ordinary skill in the art would appreciate that FIGS. 2-5 in no way represent all possible permutations of floor panels and walls to define a building unit nor all permutations of building units to define a story of a building.

As described herein, the prefabricated walls 152 may include walls that partition the building 100 into the various building units 110, walls that partition the interior of each building unit 110 into two or more rooms, walls that include utility components, walls that include window components, walls that define terminal ends of the building 100, and others. Walls that define partitions between building units 110 may be referred to as demising walls (e.g., demising wall 154). In a preferred example, the demising walls 154 are internal walls positioned within the envelope of the building 100 such that the walls are not exposed to the elements. In similar fashion, walls that include utility components may be referred to as utility walls (e.g., utility wall 160), walls that include window components, such as one or more windows, may be referred to as window walls (e.g., window wall 158), and walls that define the terminal ends of the building 100 may be referred to as end walls (e.g., end wall 156). In such examples, the utility and window walls 160, 158 may define the terminal sides of the building 100. In some examples, the utility walls 160, window walls 158, and/or end walls 156 may be positioned around at least a portion of the perimeter of the building 100 to at least partially define the envelope of the building 100.

In some examples, each wall 152 may be prefabricated for a single purpose. For instance, the utility components (e.g., plumbing, sewer, electrical) of the building 100 may run through only the utility walls 160, the window components of the building 100 may be arranged within only the window walls 158, and so on. As further example, the end walls 156 may be prefabricated to enclose only the opposite ends of the building 100 to define the length L of the building 100. In such examples, the utility walls 160 and the window walls 158 may be prefabricated to enclose the opposite sides of the building 100 to define the building's width W.

The prefabricated floor panels 150 and the prefabricated walls 152 (e.g., the prefabricated demising walls 154, utility walls 160, and/or end walls 156) may be configured to reduce the overall number of separate parts delivered to the jobsite as may be required to construct the floor and wall systems of the building 100. For example, the floor panels 150 include all components or substantially all of the components (e.g., except finished floor surfaces, including the finished floor surfaces, etc.) for a floor system of the building 100. In like manner, the prefabricated walls 152 (e.g. the prefabricated demising walls 154, utility walls 160, and/or end walls 156) may include most or all of the components (e.g., except finished wall surfaces, including finished wall surfaces, etc.) for a wall system of the building 100. According to some examples herein, the floor panels 150 may be sized such that they span a portion or a full length of a building unit 110, such as a full length between opposite walls of the building unit 110, which in some cases may correspond to the opposite exterior walls of the building 100. In some examples, the floor panels 150 may be sized such that two or more floor panels 150 (e.g., two floor panels 150, three floor panels 150, six floor panels 150, etc.) are joined together to form the floor system of an entire building unit 110 and/or story 104 of the building 100. For example, two or more floor panels 150 may be joined side-to-side to define one of the dimensions of the building unit 110 (e.g., the unit width $W_{Unit}$) while the other dimension may be defined by the length of one or more floor panels 150 connected on end.

FIGS. 6-9 illustrate example prefabricated floor panels 150 and prefabricated walls 152 according to various examples of the present disclosure. In typical multi-story building construction, steel framing is used in conjunction with concrete for constructing the wall system and/or the floor system of the building. Concrete slabs may slow the construction process as individual concrete slabs are poured and cured in situ at each level or story as each new level or story of the building is added. Temporary formwork for the concrete slab is installed at each level and the construction crew must wait for the concrete to cure prior to removal of the temporary formwork and completion of other elements (e.g., exterior and interior walls, window installation, various interiors elements including plumbing, mechanical, and electrical systems and finishes), which may significantly increase construction timeline and cost. Pre-cast concrete slabs may be used instead of casting the slabs in situ. However, there may be some limitations to using pre-cast slabs such as the weight of the slabs themselves and the associated difficulty in transporting and installing such pre-cast slabs. Also, stricter dimensional tolerances for the pre-cast slabs and building frame construction may need to be followed to ensure the slabs can be installed to the building frame. In addition, building construction using concrete slab construction tend to be significantly heavier and costlier. For example, a floor system with a concrete slab may weigh between about 50 lb/ft$^2$ and about 100 lb/ft$^2$, and may cost about \$40/ft$^2$.

On the other hand, the present disclosure describes prefabricated components and methods for building construction and specifically for constructing a building 100 using prefabricated walls 152 and floor panels 150, and without the use of onsite floor and wall construction. In one example, floor systems implementing the examples herein may weigh and cost significantly less, such as weighing about 10 lb/ft$^2$ and costing about \$10/ft$^2$. In addition, floor systems implementing the examples herein may be significantly faster to construct compared to conventional slab construction. Similar results may be achieved implementing the prefabricated wall systems described herein.

Figure 6:
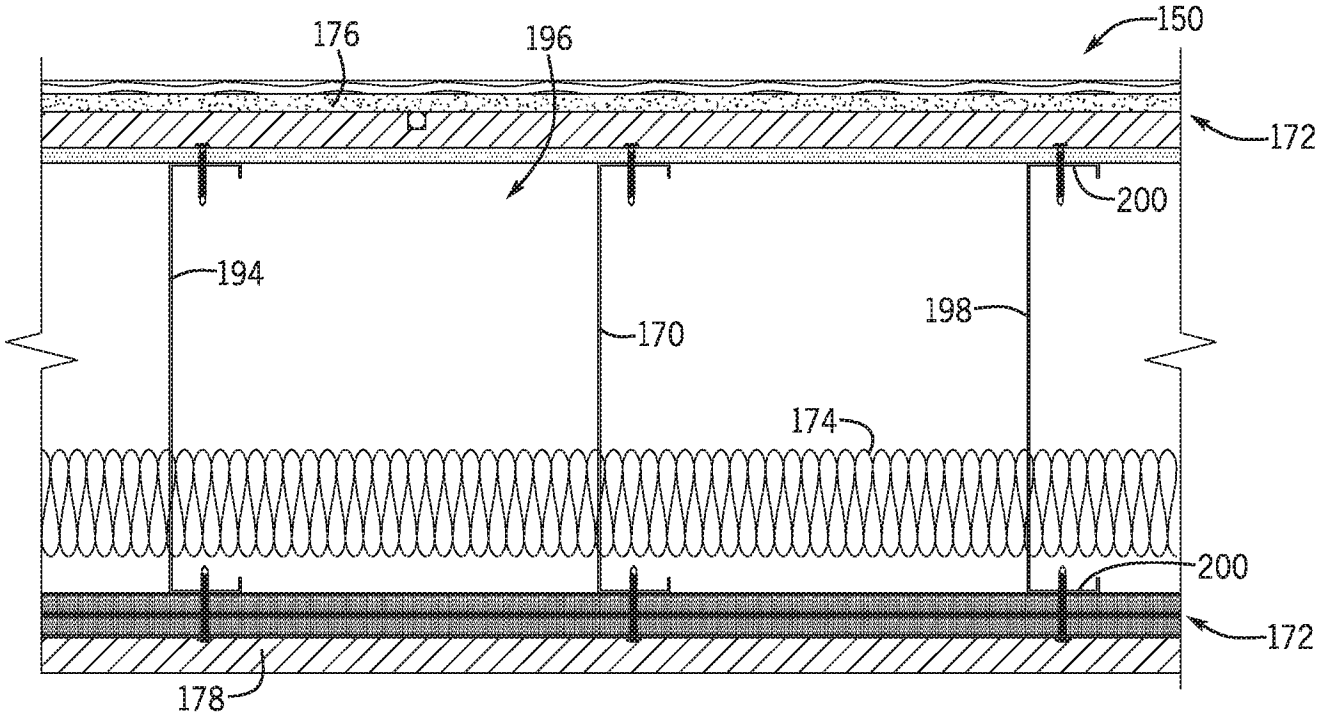
FIG. 6 is a partial cross-sectional view of a prefabricated floor panel according to one example.

The floor panels 150 may be prefabricated in any suitable manner. As one example, FIG. 6 illustrates a floor panel 150 according to one embodiment of the present disclosure. According to various examples herein, each floor panel 150 includes a frame 170 and outer layers 172 attached to the frame 170, such as to opposite sides of the frame 170. The outer layers 172 may be attached to the frame 170 in any suitable manner, such as by adhesive, fasteners, corresponding retention features, or any combination thereof. As shown in FIG. 6, an insulative material 174 (e.g., mineral wool batt insulation) may be positioned between the outer layers 172, such as within the frame 170, to provide thermal insulative and/or sound deadening properties to the floor panel 150.

As an example of an outer layer 172, a floor layer 176 may be disposed over and attached to the frame 170, such as attached to a top side of the frame 170. As an additional or alternative example of an outer layer 172, a ceiling layer 178 may be disposed below and attached to the frame 170, such as attached to a bottom side of the frame 170. In such embodiments, the floor layer 176 may support a floor material (e.g., a floor finish) of an upper story 104, and the ceiling layer 178 may support a ceiling material (e.g., a ceiling finish) of a lower story 104. In this manner, once installed in the building 100, each floor panel 150 may provide a floor and a ceiling for two vertically adjacent building units 110. For example, the floor layer 176 of each floor panel 150 may define the floor of an upper building unit 110 or story 104 of the building 100, and the ceiling layer 178 of each floor panel 150 may define the ceiling of a lower building unit 110 or story 104. In one embodiment, each of the floor and ceiling layers 176, 178 may include one or more stacked layers of boards or material, such as drywall, particle board, OSB, or the like.

Each floor panel 150 may take on any suitable shape or configuration. For instance, and without limitation, each floor panel 150 may be quadrilateral in shape and may include opposite ends 190 and opposite sides 192 extending between the opposite ends 190 (see FIG. 10). In such embodiments, the opposite ends 190 may define the length of the floor panel 150, and the opposite sides 192 may define the width of the floor panel 150. In a preferred example, the opposite sides 192 are longer than the opposite ends 190 such that each floor panel 150 includes a rectangular shape. As explained more fully below, at least one of the opposite ends 190 and opposite sides 192 may include connection structures operable to couple each floor panel 150 to other structure, such as to the structural frame 102 (e.g., to the floor beams 122) and/or to other prefabricated components 106 (e.g., to the prefabricated walls 152).

Each floor panel 150 may be operable to carry loads (e.g., diaphragm loads) to the structural frame 102. For example, to provide structural rigidity and strength to the floor panels 150, the frame 170 of each floor panel 150 may include a plurality of joists 194 extending between the opposite ends 190 of the floor panel 150 and in spaced arrangement along the width of the floor panel 150 (such as equidistantly spaced between the opposite sides 192 of the floor panel 150). In such embodiments, the joists 194 may define supporting members that span between the opposite ends 190 of the floor panel 150 to support the floor and ceiling layers 176, 178 of the floor panel 150. For instance, each of the floor and ceiling layers 176, 178 of the floor panel 150 may be attached to the joists 194 (e.g., via adhesive, fasteners, or the like). The joists 194 may be arranged generally parallel to one another, such as along the length of the floor panel 150. In some examples, the joists 194 may be spaced at regular intervals along the width of the floor panel 150 (e.g., on 6 inch centers, on 12 inch centers, on 16 inch centers, on 36 inch centers, etc.) to define a joist cavity 196 between adjacent joists 194. In such embodiments, the joist cavities 196 may accommodate plumbing, wiring, HVAC ductwork, or other elements that support dwelling or commercial activities in the building 100. For example, the insulative material 174 may be positioned within the joist cavities 196 to provide a degree of thermal insulation and/or sound deadening quality to the floor panel 150.

Each floor panel 150 may be fabricated using discrete (e.g., separable) pre-manufactured construction elements (e.g., boards, studs, paneling, etc.), which may be fabricated offsite, such as in a factory or other location remote from the construction site. According to the present disclosure, each floor panel 150 is prefabricated (e.g., in a factory) and delivered to the construction site for installation as part of the building 100. Each floor panel 150 may be formed of any suitable material. For example, the frame 170 may be formed from metal, such as aluminum or steel. In some embodiments, the frame 170 may be formed of a non-metallic material, such as wood, plastic, fiber reinforced composites, or other material. In the illustrated example of FIG. 6, the joists 194 are formed of metal and have a C-shaped cross-section defined by a web 198 connecting opposing flanges 200, though the joists 194 may include substantially any cross-sectional shape (e.g., I-beams, etc.).

The frame 170 may be arranged to suit the particular needs of a building project. For instance, the number of joists 194, the spacing of the joists 194, the length of the joists 194 (which also defines the length of the floor panel 150), and/or the lengths of the opposite ends 190 of the floor panel 150 may be selected based on the load and/or dimensional requirements of the floor panel 150. For example, a higher load requirement may require a greater number of joists 194, and vice-versa. Similarly, a wider floor panel 150 may require a greater number of joists 194, and vice-versa. In examples where the joists 194 are metal, the height of the web 198, the width of the flanges 200, and/or the thickness (gage) of the metal may be varied as needed. Accordingly, the specific configuration illustrated in FIG. 6 is provided for illustration purposes only, and the floor panel 150 (e.g., the frame 170) may be arranged differently than specifically illustrated.

Figure 7:
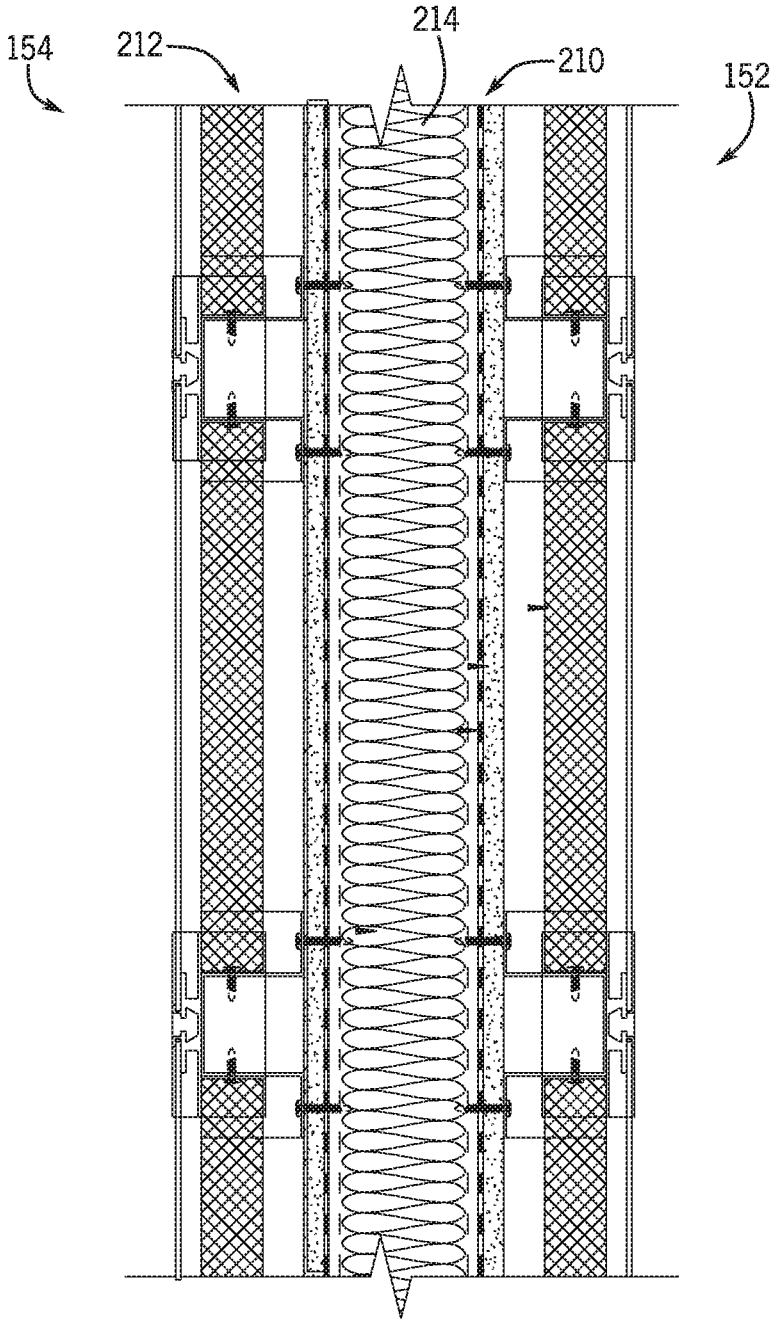
FIG. 7 is a partial cross-sectional view of a prefabricated demising wall according to one example.
Figure 8:
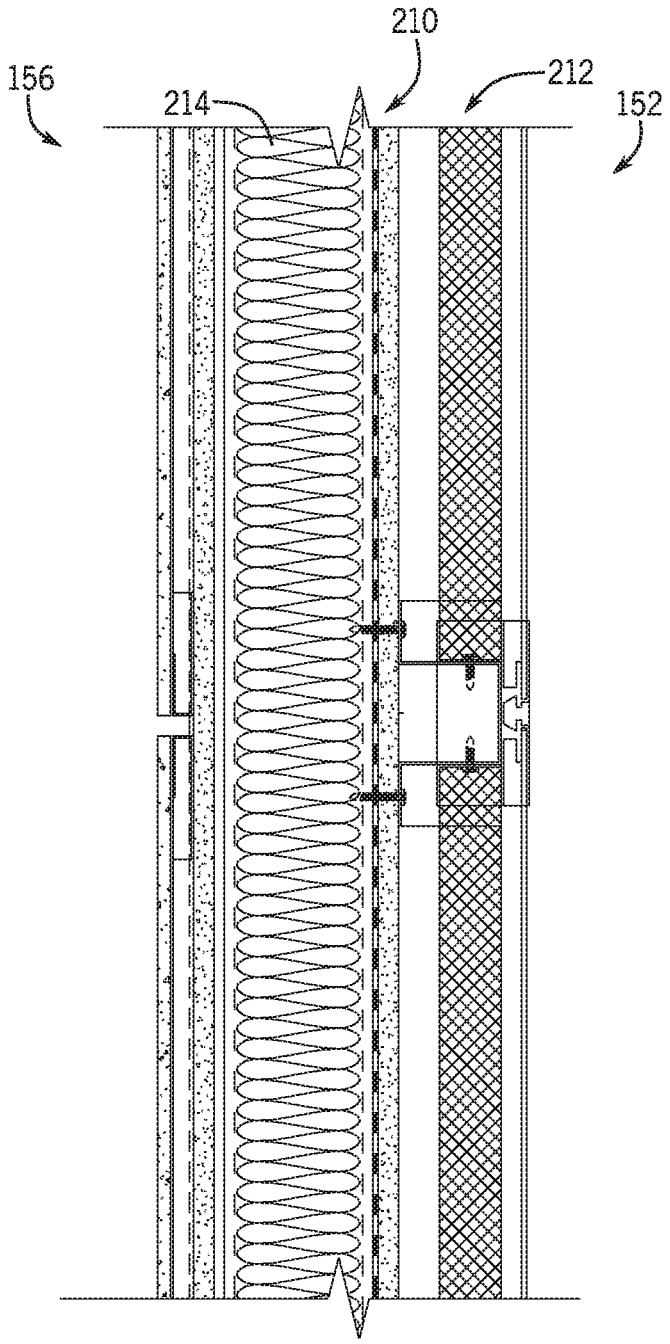
FIG. 8 is a partial cross-sectional view of a prefabricated end wall according to one example.
Figure 9:
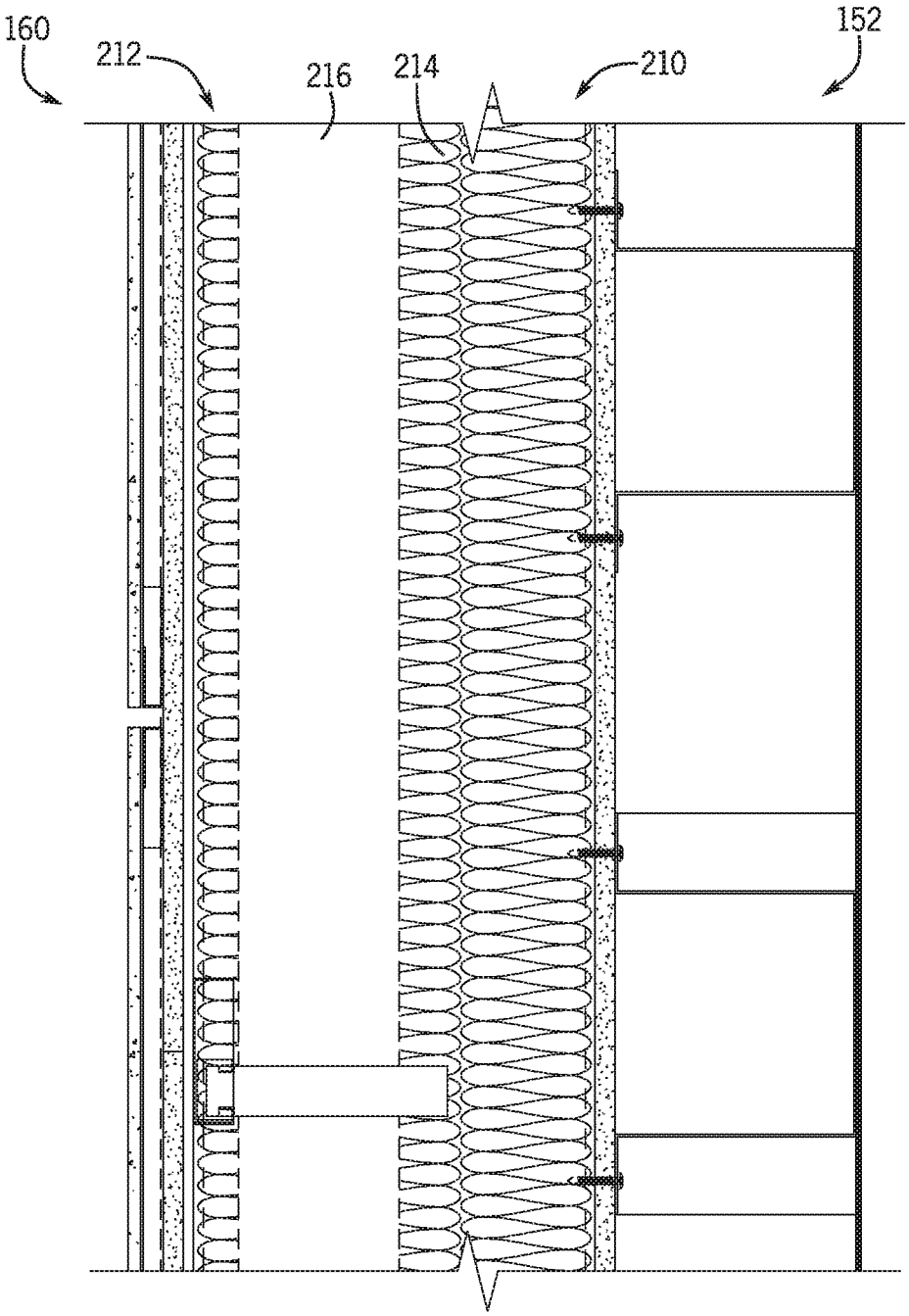
FIG. 9 is a partial cross-sectional view of a prefabricated utility wall according to one example.

FIGS. 7-9 illustrate example prefabricated walls 152, such as an example demising wall 154 (see FIG. 7), an example end wall 156 (see FIG. 8), and an example utility wall 160 (see FIG. 9), according to the present disclosure. Each prefabricated wall 152 may be configured (and prefabricated) similar to the floor panels 150 and/or similar to one another. As such, like features will not be discussed when they would be apparent to one of ordinary skill in the art in light of the description above and in view of FIGS. 7-9.

As shown in FIGS. 7-9, each demising wall 154, utility wall 160, and end wall 156 may include a frame 210 operable to carry loads to the structural frame 102, and one or more outer layers 212 attached to the frame 210 to provide a desired aesthetic and/or functional characteristic. For instance, the outer layers 212 may be attached to opposite sides of the frame 210 such that the frame 210 is positioned at least partially between the outer layers 212. In one example, the outer layers 212 of each prefabricated wall 152 may provide an attachment point to which to install various interior and/or exterior finishes of the building 100 (e.g., interior drywall, exterior paneling or siding, etc.). Each prefabricated wall 152 may also include an insulative material 214 (e.g., mineral wool batt insulation) positioned between the outer layers 212, such as within the frame 210, to provide thermal insulative and/or sound deadening properties across the wall 152. Similar to the floor panels 150, each prefabricated wall 152 may include connection structures configured to couple the walls 152 to the structural frame 102 (such as to the columns 120 and/or to the beams 122) and/or to an adjacent floor panel 150. As shown in FIG. 9, each utility wall 160 may include plumbing components 216 (e.g., piping) to supply water to the building unit 110 as well as to provide drainage of sewer water and greywater. The specific configurations of the prefabricated walls 152 illustrated in FIGS. 7-9 are provided for illustration purposes only, and the walls 152 may be arranged differently than specifically illustrated.

Figure 10:
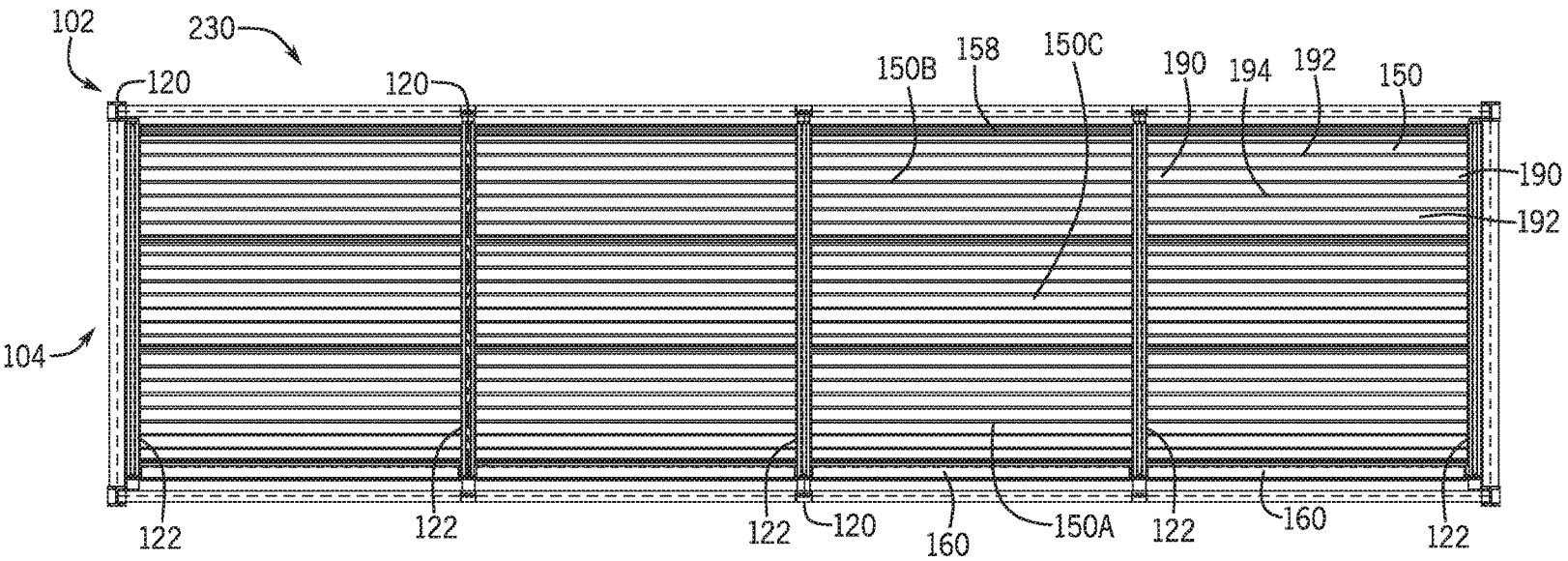
FIG. 10 is a schematic illustration of an example floor system of a building assembled from a plurality of prefabricated floor panels.

FIG. 10 illustrates an example floor system 230 of the building 100 assembled from a plurality of prefabricated floor panels 150 in accordance with a floor plan. As shown, the floor system 230, which may be the floor system for any story 104 of the building 100 (e.g., the first floor 104A, the second floor 104B, the third floor 104C, the nth floor 104N, etc.), is assembled (in accordance with a floor plan as outlined above) by positioning a plurality of floor panels 150 side-to-side and on end to define a floor of a building unit 110 or story 104 of the building 100. In one embodiment, one floor panel 150 (e.g., a first floor panel 150A) may be installed in a position adjacent a utility wall 160. Similarly, another floor panel 150 (e.g., a second floor panel 150B) may be installed in a position adjacent a window wall 158. In such embodiments, an additional floor panel 150 (e.g., a third floor panel 150C) may be installed in a position between the first and second floor panels 150A, 150B positioned adjacent the window and utility walls 158, 160, respectively.

To aid construction efficiency, in some embodiments, the floor panels 150 may be arranged to be installed in any position of the floor system 230. In this manner, the floor panels 150 may be interchangeable with each other, which may reduce installation time (and costs). In some embodiments, the floor panels 150 may be individualized for a particular position within the floor system 230. For example, one floor panel 150 may be arranged to be installed only adjacent a utility wall 160, such as in examples where the floor panel 150 is prefabricated to include plumbing components (e.g., shower pans, sink drains, etc.). In like manner, another floor panel 150 may be arranged to be installed only adjacent a window wall 158, such as in examples where the floor panel 150 is prefabricated to include sealing tracks for a window.

The floor panels 150 may be installed in any suitable manner. For example, the floor panels 150 may be attached or otherwise coupled to the structural frame 102 (e.g., to the beams 122 of the structural frame 102). According to at least one example of the present disclosure, the floor panels 150 may be installed to and between adjacent beams 122 in a manner to support anticipated loads thereon (e.g., building occupants, furniture, furnishings, etc.). For example, the connection structures of the floor panels 150 may facilitate the opposite ends 190 of the floor panels 150 to be attached or otherwise coupled to adjacent beams 122, such as by welding, bolting, interlocking structural features or other suitable manner.

Figure 11:
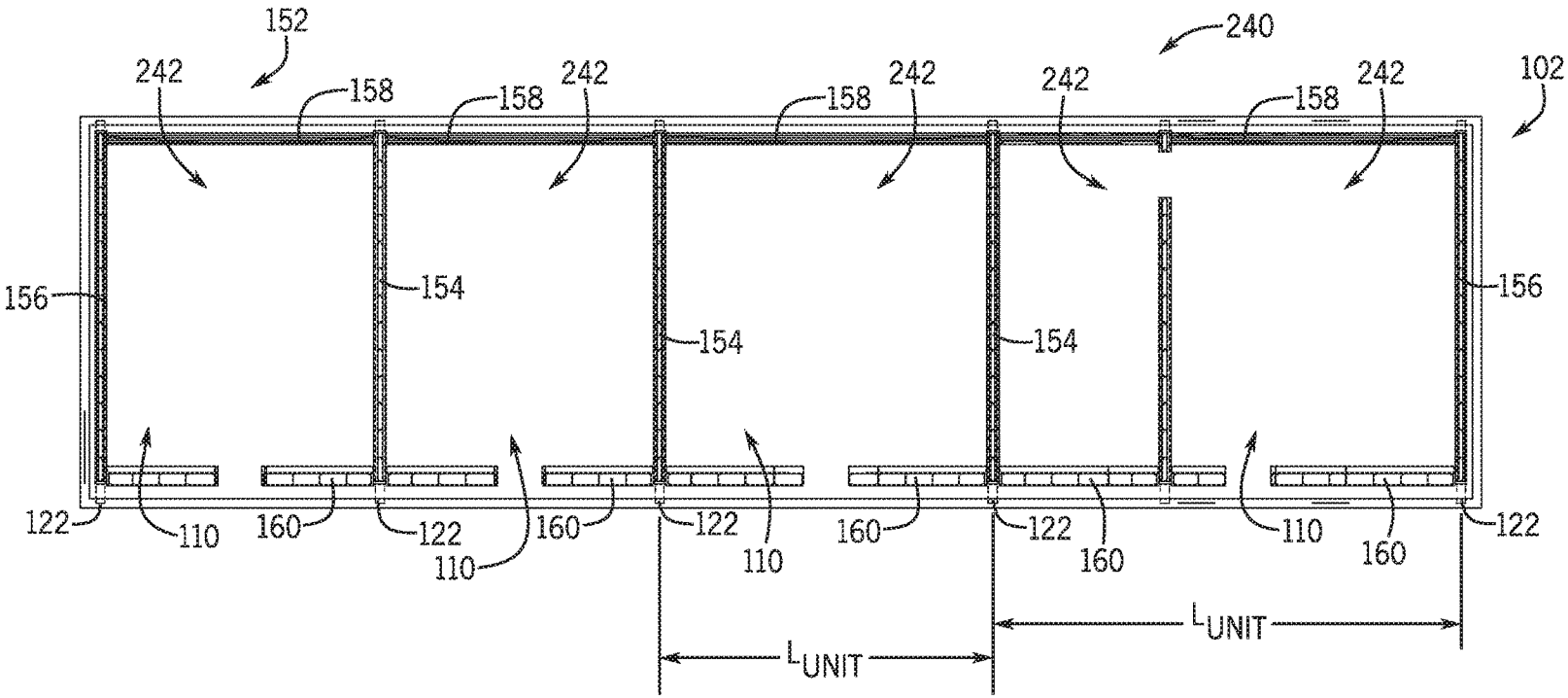
FIG. 11 is a schematic illustration of an example wall system of a building assembled from a plurality of prefabricated walls.

FIG. 11 illustrates a wall system 240 of the building 100 assembled from a plurality of prefabricated walls 152 in accordance with a floor plan. As described herein, the wall system 240 is assembled in accordance with a floor plan using two or more prefabricated walls 152. The plurality of prefabricated walls 152 may be installed to define one or more interior rooms 242 of each building unit 110. For example, the plurality of prefabricated walls 152 may be installed to define a building unit 110 having one interior room 242, two interior rooms 242, three interior rooms 242, and the like. The floor plan may define the interior rooms 242 as a bedroom, a bathroom, a living room, a kitchen, or the like. In one example, each building unit 110 consisting of one interior room 242 may be considered a studio residence, each building unit 110 consisting of two interior rooms 242 may be considered a one-bedroom residence, each building unit 110 consisting of three interior rooms 242 may be considered a two-bedroom residence, and so forth, though any suitable combination of bedrooms and other living spaces is contemplated.

Like the prefabricated floor panels 150, the prefabricated walls 152 may be configured to be installed in interchangeable positions or may be configured to be installed in specific locations. For instance, and without limitation, the plurality of prefabricated walls 152 may include one or more prefabricated utility walls (e.g., utility wall 160) arranged to provide utilities (e.g., water, sewer, electrical, etc.) to each building unit 110, one or more prefabricated demising walls (e.g., demising wall 154) arranged to partition each story 104 into two or more building units 110, one or more window walls (e.g., window wall 158), one or more prefabricated end walls (e.g., end wall 156) arranged to define the terminal ends of each story 104 of the building 100, or any combination thereof. In such embodiments, the utility, demising, window, and end walls 160, 154, 158, 156, may be installed interchangeably within the various building units 110. For example, and without limitation, the demising wall 154 of one building unit 110 may be used interchangeably for the demising wall 154 of another building unit 110. In some embodiments, the utility, demising, window, and end walls 160, 154, 158, 156, may be configured to be installed in particular building units 110 in accordance with a floor plan. For example, and without limitation, one building unit 110 may be designed to include a relatively shorter unit length $L_{Unit}$ requiring a relatively shorter utility wall 160 and/or window wall 158 in length. Similarly, another building unit 110 may be designed to include a relatively longer unit length $L_{Unit}$ requiring a relatively longer utility wall 160 and/or window wall 158 in length.

Like the floor panels 150, the prefabricated walls 152 may be installed in any suitable manner. For example, the prefabricated walls 152 may be attached or otherwise coupled to the structural frame 102 (e.g., to the beams 122 of the structural frame 102, to the columns 120 of the structural frame 102, etc.) and/or to the floor system 230. For example, each demising wall 154 may be installed adjacent (e.g., to and along) at least one floor beam 122 positioned between adjacent floor panels 150. Similarly, each end wall 156 may be installed adjacent (e.g., to and along) at least one floor beam 122 positioned at a terminal end of the building 100. Each utility wall 160 may be installed along a length of the building 100 and between adjacent floor beams 122, such as along a terminal side of the building 100. According to at least one example of the present disclosure, the prefabricated walls 152 may be installed to and between vertically adjacent beams 122. For example, the prefabricated walls 152 (e.g., the demising walls 154, the end walls 156, etc.) may be installed between a floor beam 122 of a vertically adjacent story 104 and a floor beam 122 of a vertically subjacent story 104. In this manner, the beams 122 of a vertically adjacent story 104 may extend adjacent (e.g., to and along) the tops of the prefabricated walls 152 of a vertically subjacent story 104.

Figure 12:
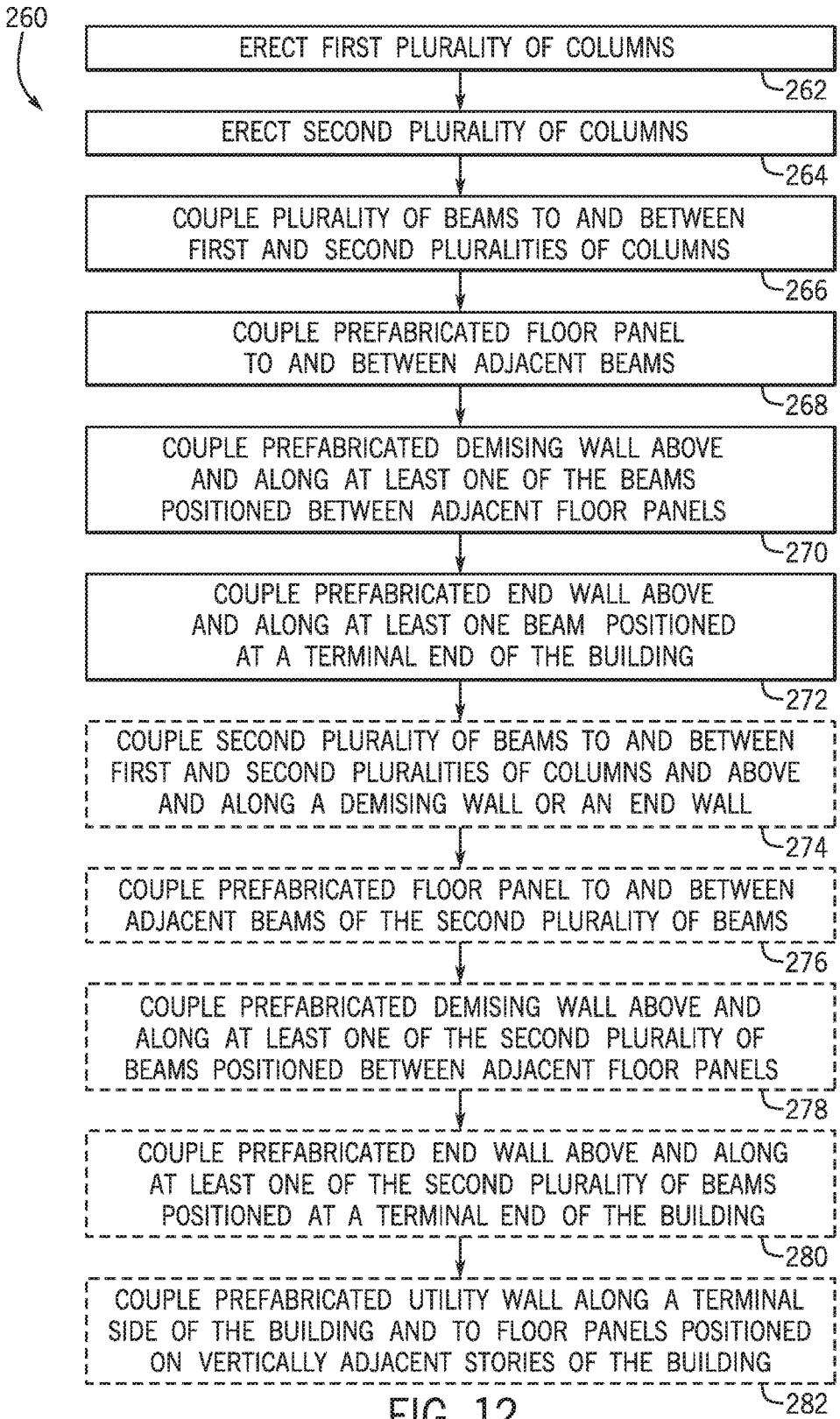
FIG. 12 is a flowchart illustrating an example method of assembling a building from prefabricated components.
Figure 13:
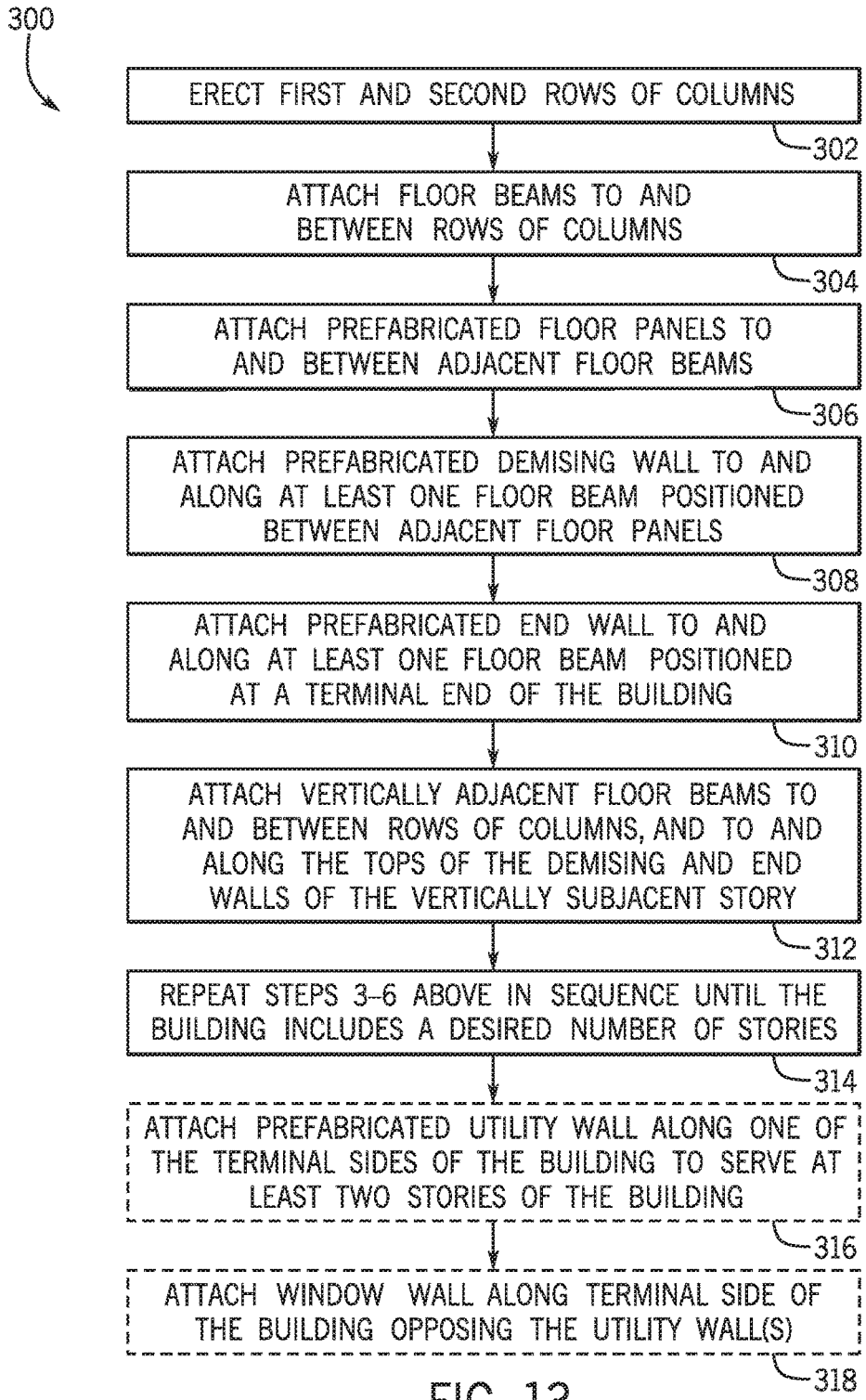
FIG. 13 is a flowchart illustrating an example method of assembling a building from prefabricated components, the building having a length and a width defining terminal ends and terminal sides of the building, respectively.
Figure 14:
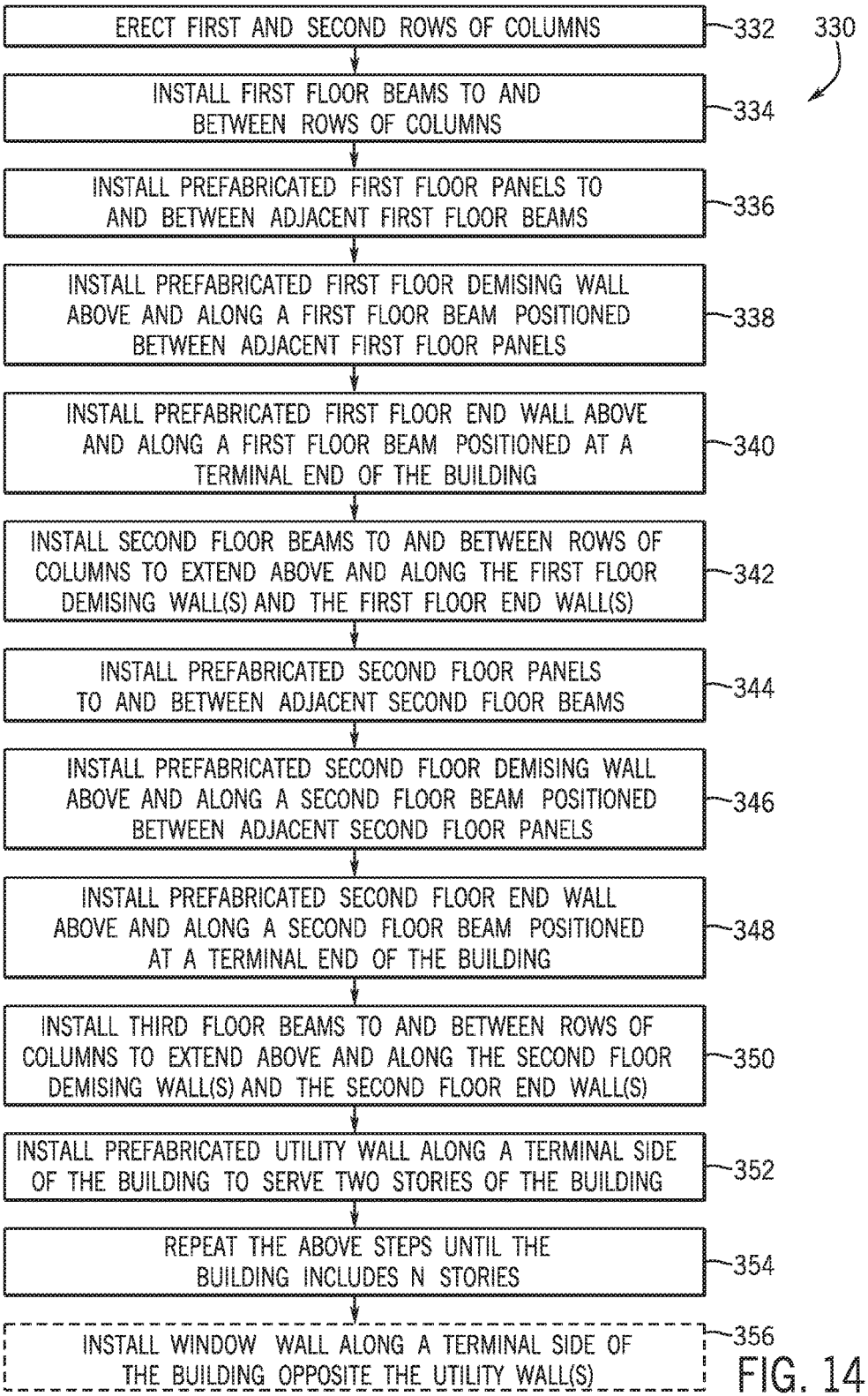
FIG. 14 is a flowchart illustrating an example method of assembling a building of n stories from prefabricated components, the building having a length and a width.

FIGS. 12-14 are flowcharts illustrating example methods of assembling a building from prefabricated components in accordance with the present disclosure. The methods may be used to assemble a building, such as building 100, from prefabricated components 106. The example methods may include one or more operations, functions, or actions as illustrated by one or more of blocks. Operations of the example methods will be described with reference also to FIGS. 1-11, with the understanding that the various components shown in FIGS. 1-11 are merely illustrative, and suitable variations are contemplated.

Referring to FIG. 12, an example method 260 of assembling a building 100 from prefabrication components 106 includes erecting a first plurality of columns 124 spatially separated along a first line (see block 262). The method further includes erecting a second plurality of columns 126 spatially separated along a second line (see block 264). In one example, the first and second lines may extend along the length of the building 100. Depending on the desired shape of the building 100, the first and second lines may extend substantially parallel to each other, may converge towards each other, may curve towards and/or away from each other, or the like. The first and second pluralities of columns may be erected on one or more concrete footings or slabs, and may extend vertically in a plumb configuration or at an angle to a level horizontal surface.

With continued reference to FIG. 12, the method 260 includes coupling a plurality of beams 122 to and between the first and second pluralities of columns (see block 266). Each beam 122 may extend between one column of the first plurality of columns 124 and an opposing column of the second plurality of columns 126 such that the beams 122 extend substantially parallel to one another. In some embodiments, the beams 122 may be equidistantly spaced from one another along the length of the building 100) to reduce the number of assembly parts and aid in quick and efficient construction of the building 100. Each beam 122 may be coupled or otherwise attached to its corresponding columns of the first and second pluralities of columns in a variety of manners. For example, and without limitation, each beam 122 may be directly attached or ultimately coupled to a web portion of the columns 120.

The method 260 further includes coupling a prefabricated floor panel 150 to and between adjacent beams 122 (see block 268). As explained above, the prefabricated floor panel 150 may include opposite ends 190, opposite sides 192 extending between the opposite ends 190, and a plurality of joists 194 in a spaced arrangement and extending between the opposite ends 190. In such embodiments, the opposite ends 190 of each prefabricated floor panel 150 may be coupled to adjacent beams 122 with the opposite sides 192 extending between the adjacent beams 122. In one example, block 268 includes coupling a plurality of prefabricated floor panels 150 (e.g., three prefabricated floor panels 150) to and between each pair of adjacent beams 122, the plurality of prefabricated floor panels 150 abutting one another along the sides of the floor panels 150 (see FIG. 10). In each example described herein, one of the opposite sides 192 of each prefabricated floor panel 150 positioned adjacent a terminal side of the building 100 may define an outer side arranged to sealingly receive a window along its length, such as window wall.

The method 260 includes coupling a variety of prefabricated walls 152 to define one or more building units 110 on each story 104 of the building 100. For example, and without limitation, the method 260 shown in FIG. 12 includes coupling a prefabricated demising wall 154 above and along at least one of the plurality of beams 122 positioned between the ends of adjacent prefabricated floor panels 150 (see block 270). In such examples, the demising wall(s) 154 may cover or otherwise conceal the space between the ends of adjacent floor panels 150 to provide a desired aesthetic and/or functional characteristic. For example, each demising wall 154 may provide a clean transition between the floor panel(s) 150 and the demising wall 154. In some examples, at least a portion of each demising wall 154 may abut the floor beam extending subjacent thereto to transfer loads directly to the structural frame 102, for instance. In some embodiments, at least a portion of each demising wall 154 may rest on the floor panels 150 positioned below each demising wall 154. Additionally or alternatively, the method may include coupling a prefabricated end wall 156 above and along at least one of the plurality of beams 122 positioned at a terminal end of the building 100 (see block 272). The end wall 156 may be configured similar to the demising wall 154.

The method 260 may include additional steps in some examples. For instance, the method 260 may include coupling a second plurality of beams 132 to and between the first and second pluralities of columns 124, 126 (see block 274 in phantom). Each beam of the second plurality of beams 132 may extend above and along at least one prefabricated demising wall 154 or at least one end wall 156 positioned vertically subjacent to the second plurality of beams 132. In such examples, each beam of the second plurality of beams 132 may rest on the vertically subjacent demising or end wall 154, 156. The method 260 may include coupling a prefabricated second floor panel 150 to and between adjacent beams of the second plurality of beams 132 (see block 276 in phantom). In such embodiments, the underside of each prefabricated second floor panel 150 may define the ceiling of the vertically subjacent floor, as explained above.

As shown in FIG. 12, the method 260 may include coupling a prefabricated second demising wall 154 above and along at least one of the second plurality of beams 132 positioned between the ends of adjacent prefabricated second floor panels 150 (see block 278 in phantom). The method 260 may include coupling a prefabricated second end wall 156 above and along at least one of the second plurality of beams 132 positioned at a terminal end of the building 100 (see block 280 in phantom). The method 260 may include coupling a prefabricated utility wall 160 along a terminal side of the building 100 (see block 282 in phantom). Each prefabricated utility wall 160 may be coupled to at least one of the prefabricated floor panels 150 and at least one of the prefabricated second floor panels 150 positioned adjacent the terminal side of the building 100. In this manner, each utility wall 160 may service at least two floors or stories 104 of the building 100.

FIG. 13 illustrates an example method 300 of assembling a building 100 from prefabricated components 106, the building 100 having a length L and a width W defining terminals ends and terminal sides of the building 100, respectively. Except as otherwise noted below, the method 300 shown in FIG. 13 is similar to the method 260 shown in FIG. 12 and described above. The method 300 includes erecting first and second rows of columns 124, 126 along the length L of building 100 (see block 302). The first and second rows of columns 124, 126 may be erected similar to the columns described above, such as substantially parallel to each other. Additionally or alternatively, the columns 120 in each of the first and second rows of columns 124, 126 may be equidistantly spaced from one other along the length L of the building 100.

Irrespective of the spatial position of the first and second rows of columns 124, 126, the method 300 includes attaching a plurality of floor beams 122 to and between the first and second rows of columns 124, 126 such that the floor beams 122 extend substantially parallel to one another along the width W of the building 100 (see block 304). Once the floor beams 122 are attached to the first and second rows of columns 124, 126, the method 300 includes attaching a prefabricated floor panel 150 to and between adjacent floor beams 122 (see block 306). Thereafter, the method 300 includes attaching a prefabricated demising wall 154 to and along at least one of the floor beams 122 positioned between adjacent floor panels 150 (see block 308). The method 300 may then include attaching a prefabricated end wall 156 to and along at least one of the plurality of floor beams 122 positioned at the terminal ends of the building 100 (see block 310).

As shown, the method 300 also includes attaching a plurality of vertically adjacent floor beams to and between the first and second rows of columns 124, 126, the plurality of vertically adjacent floor beams attached to and along the tops of the prefabricated demising and end walls 156 of the vertically subjacent story 104 (see block 312). At block 314, the method 300 includes repeating blocks 302-312 in sequence until the building 100 includes a desired number of floors. In repeating blocks 302-312, the method 300 may include extending the lengths of the columns to achieve the desired number of stories 104.

The method 300 may include additional steps in some examples. For instance, the method 300 may include attaching at least one prefabricated utility wall 160 along one of the terminal sides of the building 100 (see block 316 in phantom). In such examples, each prefabricated utility wall 160 serves at least two stories 104 of the building 100, as outlined above. Additionally or alternatively, the method 300 may include attaching a window wall 158 along a terminal side of the building 100, such as on the terminal side of the building 100 opposing the prefabricated utility walls 160 (see block 318 in phantom).

FIG. 14 illustrates an example method 330 of assembling a building 100 of n stories from prefabricated components 106, the building 100 having a length L and a width W. Except as otherwise noted below, the method 330 shown in FIG. 14 is similar to the methods 260, 300 shown in FIGS. 12 and 13, described above. The method 330 includes erecting first and second rows of columns 124, 126 along the length L of the building 100 (see block 332). Once the first and second rows of columns 124, 126 are at least partially erected, the method 330 includes installing a plurality of first floor beams 130 to and between the first and second rows of columns 124, 126 such that the first floor beams 130 extend along the width W of the building 100 (see block 334). Once the first floor beams 130 are at least partially installed, the method 330 includes installing a prefabricated first floor panel 150 to and between adjacent beams of the first floor beams 130 (see block 336). Once a plurality of first floor panels 150 are installed, the method 330 includes installing a prefabricated first floor demising wall 154 above and along at least one of the first floor beams 130 positioned between adjacent first floor panels 150 (see block 338). The method 330 includes installing a prefabricated first floor end wall 156 above and along at least one of the first floor beams 130 positioned at terminal ends of the building 100 (see block 340).

With continued reference to FIG. 14, the method 330 includes installing additional components to construct vertically adjacent floors or stories 104. For example, once the first floor demising and end walls 154, 156 are installed, the method 330 includes installing a plurality of second floor beams 132 to and between the first and second rows of columns 124, 126 such that the second floor beams 132 extend along the width W of the building 100 above and along the prefabricated first floor demising walls 154 and the prefabricated first floor end walls 156 (see block 342). Once the second floor beams 132 are at least partially installed, the method 330 includes installing a prefabricated second floor panel 150 to and between adjacent beams of the second floor beams 132 (see block 344). Once a plurality of second floor panels 150 are installed, the method 330 includes installing a prefabricated second floor demising wall 154 above and along at least one of the second floor beams 132 positioned between adjacent second floor panels 150 (see block 346).

As illustrated, at block 348, the method 330 includes installing a prefabricated second floor end wall 156 above and along at least one of the second floor beams 132 positioned at terminal ends of the building 100. Once the second floor demising and end walls 154, 156 are installed, the method 330 includes installing a plurality of third floor beams 134 to and between the first and second rows of columns 124, 126 such that the third floor beams 134 extend along the width W of the building 100 above and along the prefabricated second floor demising walls 154 and the prefabricated second floor end walls 156 (see block 350). In the example method illustrated in FIG. 14, the method 330 includes installing a prefabricated utility wall 160 along a terminal side of the building 100 (see block 352). As noted above, each prefabricated utility wall 160 may serve a plurality of stories 104, such as serving two stories 104. As shown in FIG. 14, the method 330 includes repeating the steps above (i.e., repeating blocks 332-352) until the building 100 includes n stories 104 (see block 354).

In some examples, the repeating step of block 354 may include extending the lengths of the columns to accommodate n floors. For example, additional lengths of column may be welded, attached, or otherwise coupled to the first and second rows of columns 124, 126 to accommodate additional stories 104 being added to the building 100. The columns 120 may be supplied in 1, 2, 3, or 4 story lengths (or any combination thereof). In this manner, additional lengths may be added to the columns 120 to accommodate any number of stories 104 in the building 100. In some examples, the method 330 may include installing a window wall 158 along a terminal side of the building 100, such as along the terminal side of the building 100 opposite the prefabricated utility wall 160 (see block 356 in phantom). Installing the window wall 158 may include attaching a window along corresponding tracks pre-installed on the prefabricated floor panels 150.

The blocks included in the described example methods are for illustration purposes. In some embodiments, the blocks may be performed in a different order. In some embodiments, two or more blocks may be performed concurrently. In other embodiments, the blocks may be performed serially, with subsequent blocks not being performed until all previous blocks are fully completed. In some embodiments, various blocks may be eliminated. In still other embodiments, various blocks may be divided into additional blocks, supplemented with other blocks, or combined together into fewer blocks. Other variations of the illustrative blocks are contemplated, including changes in the order of the blocks, changes in the content of the blocks being split or combined into other blocks, etc.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular examples only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markups groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A method to assemble a building from prefabricated components, the method comprising:

erecting a first plurality of columns spatially separated along a first line;

erecting a second plurality of columns spatially separated along a second line;

coupling a plurality of beams to and between the first and second pluralities of columns, wherein each beam of the plurality of beams extends between one column of the first plurality of columns and an opposing column of the second plurality of columns such that the plurality of beams extend substantially parallel to one another;

coupling a prefabricated floor panel to and between adjacent beams of the plurality of beams, wherein the prefabricated floor panel comprises opposite ends and opposite sides extending between the opposite ends, wherein the opposite ends of each prefabricated floor panel are coupled to adjacent beams, and wherein the prefabricated floor panel includes a plurality of joists in a spaced arrangement and that extend between the opposite ends;

coupling a prefabricated demising wall above and along at least one beam of the plurality of beams, wherein the at least one beam is positioned between the opposite ends of adjacent prefabricated floor panels; and coupling a prefabricated end wall above and along at least another beam of the plurality of beams, wherein the at least another beam is positioned at a terminal end of the building.

2. The method of claim 1, wherein one of the opposite sides of each prefabricated floor panel that is positioned adjacent to a terminal side of the building defines an outer side arranged to sealingly receive a window along a length of the outer side.

3. The method of claim 1, wherein the second line extends substantially parallel to the first line.

4. The method of claim 1, wherein coupling the prefabricated floor panel to and between adjacent beams of the plurality of beams includes coupling a plurality of prefabricated floor panels to and between each pair of adjacent beams of the plurality of beams, and wherein the plurality of prefabricated floor panels abut one another along sides of the plurality of prefabricated floor panels.

5. The method of claim 4, wherein coupling the plurality of prefabricated floor panels to and between adjacent beams of the plurality of beams includes coupling three prefabricated floor panels to and between each pair of adjacent beams.

6. The method of claim 1, wherein the plurality of beams includes a first plurality of beams, and wherein the method further comprises:

coupling a second plurality of beams to and between the first and second pluralities of columns, wherein each beam of the second plurality of beams extends above and along at least one prefabricated demising wall or at least one prefabricated end wall.

7. The method of claim 6, wherein the prefabricated floor panel includes a prefabricated first floor panel, and wherein the method further comprises:

coupling a prefabricated second floor panel to and between adjacent beams of the second plurality of beams.

8. The method of claim 7, wherein the prefabricated demising wall includes a prefabricated first demising wall, and wherein the method further comprises:

coupling a prefabricated second demising wall above and along at least one beam of the second plurality of beams, wherein the at least one beam of the second plurality of beams is positioned between ends of adjacent prefabricated second floor panels.

9. The method of claim 8, wherein the prefabricated end wall includes a prefabricated first end wall, and wherein the method further comprises:

coupling a prefabricated second end wall above and along at least another beam of the second plurality of beams, wherein the at least another beam of the second plurality of beams is positioned at the terminal end of the building.

10. The method of claim 9, further comprising coupling a prefabricated utility wall along a terminal side of the building, wherein each prefabricated utility wall is coupled to at least one first floor panel of a plurality of prefabricated first floor panels and at least one second floor panel of a plurality of prefabricated second floor panels, wherein the at least one second floor panel is positioned adjacent to the terminal side of the building.

11. A building assembled according to the method of claim 1.

12. A method to assemble a building from prefabricated components, wherein the building includes a length and a width that define terminal ends and terminal sides of the building, respectively, the method comprising:

erecting first and second rows of columns along the length of the building;

attaching a plurality of floor beams to and between the first and second rows of columns such that the plurality of floor beams extend substantially parallel to one another along the width of the building;

attaching a prefabricated floor panel to and between adjacent floor beams of the plurality of floor beams;

attaching a prefabricated demising wall to and along at least one floor beam of the plurality of floor beams, wherein the at least one floor beam is positioned between adjacent prefabricated floor panels;

attaching a prefabricated end wall to and along at least another floor beam of the plurality of floor beams, wherein the at least another floor beam is positioned at a terminal end of the building;

attaching a plurality of vertically adjacent floor beams to and between the first and second rows of columns, wherein the plurality of vertically adjacent floor beams are attached to and along the tops of the prefabricated demising and end walls of the vertically subjacent story; and repeating the attaching the prefabricated floor panel, attaching the prefabricated demising wall, attaching the prefabricated end wall, and attaching the plurality of vertically adjacent floor beams, in sequence until the building includes a particular number of stories.

13. The method of claim 12, wherein the first and second rows of columns are erected substantially parallel to each other.

14. The method of claim 12, wherein the repeating includes extending lengths of the columns to achieve the particular number of stories.

15. The method of claim 12, further comprising attaching at least one prefabricated utility wall along one of the terminal sides of the building, wherein each prefabricated utility wall serves at least two stories of the building.

16. The method of claim 15, further comprising attaching a window wall along a terminal side of the building that opposes the at least one prefabricated utility wall.

17. A building assembled according to the method of claim 12.

18. A method to assemble a building of n stories from prefabricated components, wherein the building includes a length and a width, the method comprising:

erecting first and second rows of columns along the length of the building;

installing a plurality of first floor beams to and between the first and second rows of columns such that the plurality of first floor beams extend along the width of the building;

installing a prefabricated first floor panel to and between adjacent first floor beams of the plurality of first floor beams;

installing a prefabricated first floor demising wall above and along at least one first floor beam of the plurality of first floor beams, wherein the at least one first floor beam of the plurality of first floor beams is positioned between adjacent prefabricated first floor panels;

installing a prefabricated first floor end wall above and along at least another first floor beam of the plurality of first floor beams, wherein the at least another first floor beam of the plurality of first floor beams is positioned at terminal ends of the building;

installing a plurality of second floor beams to and between the first and second rows of columns such that the plurality of second floor beams extend along the width of the building, wherein the plurality of second floor beams extend above and along prefabricated first floor demising walls and prefabricated first floor end walls;

installing a prefabricated second floor panel to and between adjacent second floor beams of the plurality of second floor beams;

installing a prefabricated second floor demising wall above and along at least one second floor beam of the plurality of second floor beams, wherein the at least one second floor beam of the plurality of second floor beams is positioned between adjacent prefabricated second floor panels;

installing a prefabricated second floor end wall above and along at least another second floor beam of the plurality of second floor beams, wherein the at least another second floor beam of the plurality of second floor beams is positioned at the terminal ends of the building;

installing a plurality of third floor beams to and between the first and second rows of columns such that the plurality of third floor beams extend along the width of the building, wherein the plurality of third floor beams extend above and along prefabricated second floor demising walls and prefabricated second floor end walls; and installing a prefabricated utility wall along a terminal side of the building, wherein each prefabricated utility wall serves two stories of the building.

19. The method of claim 18, wherein lengths of the columns are extended to accommodate the n stories.

20. The method of claim 18, further comprising installing a window wall along a terminal side of the building that is opposite the prefabricated utility wall.

21. The method of claim 20, wherein installing the window wall includes attaching a window along corresponding tracks that are pre-installed on prefabricated floor panels.

22. A building assembled according to the method of claim 18.

* * * * *